US007290492B2

(12) United States Patent
Watanabe et al.

(10) Patent No.: US 7,290,492 B2
(45) Date of Patent: Nov. 6, 2007

(54) EMBROIDERY FRAME FOR SEWING MACHINE AND SEWING MACHINE PROVIDED THEREWITH

(75) Inventors: Yasuhiro Watanabe, Tokoname (JP); Kazuto Oya, Toyoake (JP); Masayuki Hori, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/546,372

(22) Filed: Oct. 12, 2006

(65) Prior Publication Data

US 2007/0079741 A1 Apr. 12, 2007

(30) Foreign Application Priority Data

Oct. 12, 2005 (JP) ..... 2005-297224

(51) Int. Cl.
*D05C 9/04* (2006.01)
*D05C 9/00* (2006.01)

(52) U.S. Cl. ..... 112/103

(58) Field of Classification Search ..... 112/103, 112/470.06, 470.09, 470.14, 470.18, 258, 112/261; 108/91
See application file for complete search history.

(56) References Cited

U.S. PATENT DOCUMENTS 3,664,288 A * 5/1972 Von Boden et al. ..... 112/103
4,296,699 A * 10/1981 Vartoukian ..... 112/148
6,336,416 B1 * 1/2002 French et al. ..... 112/103
7,194,968 B2 * 3/2007 Okazaki ..... 112/103

FOREIGN PATENT DOCUMENTS

| | | |
|---|---|---|
| JP | U 64-26396 | 2/1989 |
| JP | Y2 5-32549 | 8/1993 |
| JP | A 8-238391 | 9/1996 |
| JP | A 11-061627 | 3/1999 |
| JP | A 2000-334191 | 12/2000 |
| JP | A 2002-138360 | 5/2002 |

* cited by examiner

*Primary Examiner*—Ismael Izaguirre
(74) *Attorney, Agent, or Firm*—Oliff & Berridge, PLC

(57) ABSTRACT

An embroidery frame for a sewing machine with an embroidering function to hold workpiece cloth for execution of the embroidering function is disclosed. The embroidery frame includes a lower frame receiving a lower side of the cloth, an upper frame clamping the cloth in cooperation with the lower frame therebetween, and a clamping mechanism pressing the upper frame against the lower frame, thereby holding the upper frame. The clamping mechanism includes a coupling member coupling the upper frame to the lower frame so that the upper frame is vertically swingable between a holding position and an opening position, a locking mechanism locking the upper frame at the holding position, an unlocking mechanism unlocking the upper frame, and a frame-opening biasing member biasing the upper frame so that the upper frame is displaced to the opening position when unlocked by the unlocking mechanism.

15 Claims, 19 Drawing Sheets

EMBROIDERY FRAME FOR SEWING MACHINE AND SEWING MACHINE PROVIDED THEREWITH

CROSS-REFERENCE TO RELATED APPLICATIONS

This application is based upon and claims the benefit of priority from the prior Japanese Patent Application No. 2005-297224, filed on Oct. 12, 2005, the entire contents of which are incorporated herein by reference.

BACKGROUND OF THE INVENTION

1. Field

The present disclosure relates to an embroidery frame holding workpiece cloth for execution of an embroidering function and a sewing machine to which the embroidery frame is attachable.

2. Description of the Related Art

Conventional sewing machines with an embroidering function have provided with an embroidery frame detachably attached to a sewing machine body so that workpiece cloth to be sewn is retained. The embroidery frame conventionally includes an inner frame, an outer frame and an adjusting screw tightened or loosened so that the inner and outer frames are coupled to and decoupled from each other. Recently, however, the sewing machine of the above-described type is provided with a lower frame, an upper frame and a clamping mechanism pressing the upper frame against the lower frame and retaining both frames in the pressed state.

As a first conventional example, JP-A-H08-238391 discloses a clamp type holding frame for cloth to be sewn. The disclosed frame comprises a base frame (a lower frame), a pressing frame (an upper frame), a pair of right and left clamping mechanisms pressing and fixing the pressing frame against and to the base frame so as to be released from each other, a linking mechanism linking the pressing frame to the base frame 1 so that the pressing frame is vertically swingable and a pair of air cylinders driving the pressing frame via the linking mechanism. As the result of the above-described construction, when the air cylinders are driven, the pressing frame is displaced between a pressing/fixing position and a releasing position. See pages 3 and 4 with reference to FIG. 4 in the first example.

In the aforementioned construction, when a worker positions workpiece cloth to be sewn on the base frame in a stretched state with his/her hands and then operates an operation switch, the air cylinders are driven so that input portions of the clamping mechanism are lowered. The pressing frame is then lowered to the pressing/fixing position such that the clamping mechanism assumes a clamping state and the workpiece cloth is retained in a stretched state.

Furthermore, as a second conventional example, JP-U1-S64-26396 discloses an embroidery frame for use with a sewing machine. The embroidery frame includes a frame (lower frame), an upper pressing frame (upper frame) and an clamping mechanism further including a cloth pressing holder, an actuating arm, a link, a lever, etc.

In the above construction, when the worker operates a knob of the lever so that the lever is lifted up, the upper cloth presser is raised. In this state, when the worker positions the workpiece cloth so that a sewing start position of the cloth corresponds with a mark provided on an upper surface of the upper cloth presser. When the lever is depressed, the upper cloth presser is lowered thereby to clamp the workpiece cloth in cooperation with the frame therebetween.

In the embroidery frame of the first example, however, the clamping mechanism provided on the base frame comprises coupling members, an input lever, a clamp lever and the like which are combined together. Moreover, the air cylinders serve as a drive source for vertically moving the presser frame. As a result, the structure of the clamping mechanism becomes complicated, and the air cylinders necessitate a disposition space. Furthermore, the costs are increased.

On the other hand, the embroidery frame of the second conventional example comprises a four-bar linkage mechanism including the lever which is operated so as to be vertically moved so that the upper cloth presser is swung vertically. Consequently, the vertical dimension of the embroidery frame is increased. Furthermore, since a single lever is operated so that the upper cloth presser is lowered at once to press the entire cloth simultaneously, it is difficult to position the workpiece cloth so that the workpiece cloth is held at a normal position where the workpiece cloth is not inclined relative to the embroidery frame.

The above-described sewing machine capable of performing embroidery sewing is sometimes used to sew a continuous embroidery pattern along an edge of large workpiece cloth such as curtain. When an embroidery pattern is sewn on such large workpiece cloth, embroidery sewing is repeated at a plurality of times while part of the workpiece cloth held by the embroidery frame is changed to another part in sequence. In this case, it is important to position the workpiece cloth accurately so that an embroidery pattern is finely continuous. However, each of the above-described first and second conventional examples has a low accuracy in positioning workpiece cloth, whereupon the embroidery pattern becomes discontinuous.

SUMMARY

Therefore, an object of the disclosure is to provide an embroidery frame for a sewing machine, which comprises a lower frame, an upper frame and a clamping mechanism and in which the construction of the clamping mechanism can be simplified and the height of the clamping mechanism can be prevented from being increased, and a sewing machine provided with the above embroidery frame.

The present disclosure provides ah embroidery frame provided on a sewing machine with an embroidering function to hold workpiece cloth for execution of the embroidering function, the embroidery frame comprising a lower frame receiving a lower side of the workpiece cloth, an upper frame clamping the workpiece cloth in cooperation with the lower frame therebetween, and a clamping mechanism pressing the upper frame against the lower frame, thereby holding the upper frame. The clamping mechanism includes a coupling member coupling the upper frame to the lower frame so that the upper frame is vertically swingable between a holding position where the upper frame presses the workpiece cloth and an opening position where the upper frame is open upward, a locking mechanism locking the upper frame at the holding position, an unlocking mechanism unlocking the upper frame, and a frame-opening biasing member biasing the upper frame so that the upper frame is displaced to the opening position when unlocked by the unlocking mechanism.

The upper frame is coupled to the lower frame by the coupling member so as to be vertically swingable. When a worker sets workpiece cloth on the lower frame with the upper frame being open and then lowers the upper frame to the holding position where the workpiece cloth is pressed, the upper frame is automatically locked by the locking mechanism. Upon completion of embroidering, the worker operates the unlocking mechanism to unlock the upper frame and the upper frame is automatically opened from the holding position to the opening position by the frame-opening biasing member.

Accordingly, the workpiece cloth can be held on the embroidery frame easily and yet reliably. With this, easiness can be improved in opening the upper frame and taking out the workpiece cloth. In this case, since the clamping mechanism includes the coupling member, locking mechanism, unlocking mechanism and frame-opening biasing member, no drive source needs to be provided and thus, the construction of the clamping mechanism can be simplified. Moreover, the height of the clamping mechanism can be prevented from being increased as in the aforesaid four-bar linkage mechanism.

In one embodiment, the lower frame includes a supporting member secured thereto and the locking mechanism includes a lock lever changing the upper frame pivotally supported by the supporting member and assuming the holding position to the locked state, a lock pin provided on the lock lever for locking via the lock lever the upper frame at the holding position, an engagement hole defined in the supporting member so that the lock pin is engageable with the engagement hole when the upper frame is switched to the holding position by the lock lever, and a lock biasing member which biases the lock pin in such a direction that the lock pin engages the engagement hole.

Accordingly, the lock first biasing member causes the lock pin of the lock lever to engage with the engagement hole of the supporting member when the worker only operates the lock lever, whereby the upper frame is switched to the locked state. Consequently, the clamping operation for holding the workpiece cloth on the embroidery frame can be simplified.

In this case, the supporting member preferably includes a fixing wall which is fixed to the lower frame and a supporting wall which supports the lock lever so that the lock lever is allowed to pivot and in which the engagement hole is formed, the fixing wall and the supporting wall being disposed on the same plane. When the upper frame has been locked at the holding position, the reaction force of spring force of the frame-opening biasing member and the like acts in such a direction that a space between the fixing and supporting walls is spread. However, since the fixing and supporting walls are disposed on the same plane, a sufficient strength against the aforesaid reaction force can be ensured even when the walls are made of thin plates.

Furthermore, the unlocking mechanism preferably includes an operation member which is operated so that the lock pin and the engagement hole are disengaged from each other and a holding member which holds the operation member so that the operation member corresponds to the engagement hole of the supporting member. When only the unlocking operation member differing from the lock lever is operated in unlocking the upper frame, the lock pin and the engagement hole are instantaneously disengaged from each other, whereby the upper frame is unlocked. Consequently, the unlocking operation can be simplified.

Alternatively, the locking mechanism includes a lock lever which is swung in synchronization with the coupling member, thereby locking the upper frame at the holding position, a locking cam provided on the supporting member secured to the lower frame and having a locking cam part which enables the upper frame to assume a locked state and an unlocking cam part which allows the upper frame to unlock, the locking and unlocking parts being continuous to each other, the lock pin engaging the locking cam, and another lock biasing member which biases the lock pin so that the lock pin is held by the locking cam part.

When the worker operates the coupling member to lower the upper frame to the holding position, the second lock biasing member causes the lock pin of the lock lever to engage with the locking cam part of the locking cam, whereby the upper frame is switched to the locked state. Consequently, the clamping operation for holding the workpiece cloth on the embroidery frame can be simplified.

In this case, the unlocking mechanism has an unlocking operation member pivotally supported on the supporting member and actuating the lock lever so that the lock pin is moved from the locking cam part to the unlocking cam part against a biasing force of said another lock biasing member. When only the unlocking operation member differing from the lock lever is operated in unlocking the upper frame, the lock pin and the engagement hole are instantaneously disengaged from each other, whereby the upper frame is unlocked. Consequently, the unlocking operation can be simplified.

The coupling member preferably has a press biasing member elastically biasing the upper frame switched to the holding position to the lower frame side. Consequently, when the upper frame is locked at the holding position, the workpiece cloth can reliably be pressed against the lower frame thereby to be held.

The two clamping mechanisms are preferably provided so that an embroiderable area defined inside the upper and lower frames is located therebetween. Since the workpiece cloth to be embroidered is clamped at two individual points sandwiching the embroiderable area, the workpiece cloth can be held in a well-balanced state. Furthermore, the workpiece cloth can be clamped at two points in turn when the worker positions the workpiece cloth on the embroidery frame. Consequently, a delicate adjustment can be realized in positioning the workpiece cloth.

The embroidery frame preferably further comprises a detector capable of detecting an end of the workpiece cloth or an imaginary sewing reference line when the workpiece cloth is clamped between the upper and lower frames and an output connector for delivering to the sewing machine side a detection signal indicative of the end of the workpiece cloth or the sewing reference line detected by the detector. The detector detects the end of the workpiece cloth or sewing reference line, generating a detection signal. The detection signal is delivered via the output connector to the sewing machine body side. Accordingly, positional information about the cloth end or sewing reference line can be informed at the sewing machine body side. Consequently, the worker can easily recognize the positioning of the workpiece cloth relative to the embroidery frame and accordingly, the positioning accuracy can be improved.

In this case, when the detector comprises an optical sensor, the size and the costs of the detector can be reduced.

The invention also provides a sewing machine with an embroidering function comprising an embroidery frame holding workpiece cloth for execution of the embroidering function. The embroidery frame includes a lower frame receiving a lower side of the workpiece cloth, an upper frame clamping the workpiece cloth in cooperation with the lower frame therebetween, and a clamping mechanism pressing the upper frame against the lower frame, thereby holding the upper frame. The clamping mechanism includes a coupling member coupling the upper frame to the lower frame so that the upper frame is vertically swingable between a holding position where the upper frame presses the workpiece cloth and an opening position where the upper frame is open upward, a locking mechanism locking the upper frame at the holding position, an unlocking mechanism unlocking the upper frame, and a frame-opening biasing member biasing the upper frame so that the upper frame is displaced to the opening position when the upper frame has been unlocked by the unlocking mechanism. The embroidery frame further includes a detector capable of detecting an end of the workpiece cloth or an imaginary sewing reference line when the workpiece cloth is clamped between the upper and lower frames and an output connector for delivering to the sewing machine side a detection signal indicative of the end of the workpiece cloth or the sewing reference line detected by the detector and a sewing machine body to which the embroidery frame is attached. The sewing machine body includes an input connector connectable to the output connector of the embroidery frame and an informing unit receiving via the input connector the detection signal from the detector thereby to inform information about a position of the workpiece cloth or the sewing reference line relative to a predetermined sewing reference position.

In the above-described sewing machine, positional information about the cloth end or sewing reference line can be received via the connector and informed. Consequently, the worker can easily recognize the positioning of the workpiece cloth relative to the embroidery frame and accordingly, the positioning accuracy can be improved.

BRIEF DESCRIPTION OF THE DRAWINGS

Other objects, features and advantages of the present disclosure will become clear upon reviewing the following description of the preferred embodiments with reference to the accompanying drawings, in which.

DETAILED DESCRIPTION

Figure 1:
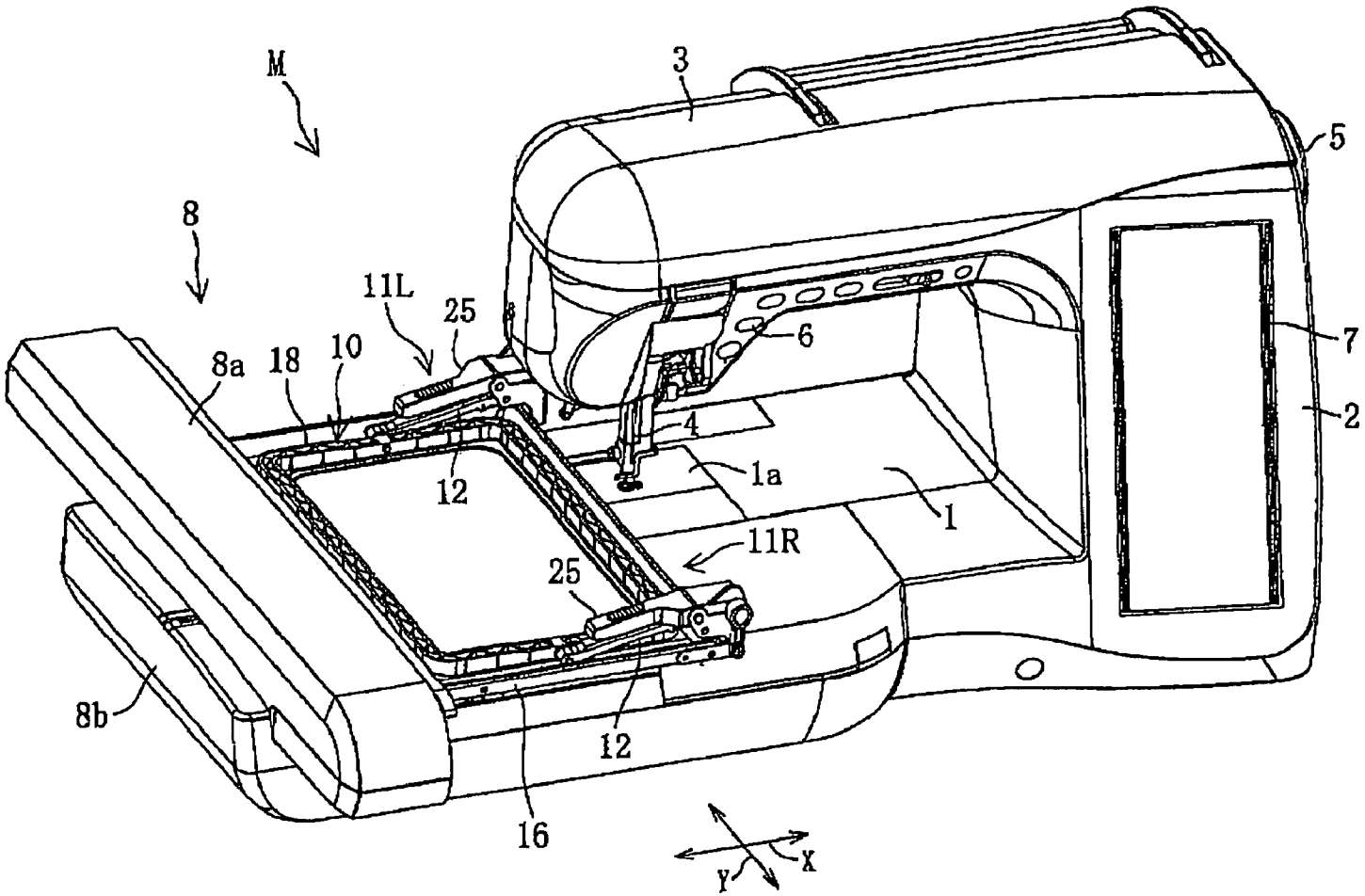
FIG. 1 is a perspective view of a sewing machine to which an embroidery frame is attached, in accordance with a first illustrative example.

The invention will be described in more detail with reference to the accompanying drawing. A first embodiment of the present invention will be described with reference to FIGS. 1 to 12. Referring to FIG. 1, an overall electronic sewing machine M with an embroidering function of the first embodiment is shown. The electronic sewing machine M includes a body having a sewing machine bed 1 extending horizontally (in the X direction), a pillar 2 standing upward from a right end of the sewing machine bed 1 and a sewing machine arm 3 extending leftward from an upper end of the pillar 2, these components being formed integrally.

The arm 3 has a distal end including a lower part on which a needle bar having a sewing needle 4 is mounted. The bed 1 has an upper side on which a needle plate 1*a* is mounted so as to correspond to the sewing needle 4. In the bed 1 are provided a feed-dog vertically moving mechanism moving a feed dog vertically, a feed-dog horizontally moving mechanism moving the feed dog horizontally, a horizontal rotary hook accommodating a lower thread bobbin and forming stitches in cooperation with the sewing needle 5, a thread cutting mechanism and the like, none of which are shown.

A sewing machine main shaft is provided in the arm 3 so as to be rotated by a sewing machine motor although not shown in the drawings. Furthermore, a hand pulley 5 is mounted on the right side of the arm 3 for manually rotating the main shaft. In the arm 3 are provided a needle bar driving mechanism which vertically moves the needle bar, a needle bar swinging mechanism which swings the needle bar in the direction (X direction) perpendicular to a cloth feeding direction, a needle thread take-up driving mechanism which vertically moves a needle thread take-up in synchronization with the vertical movement of the needle bar and the like, none of which are shown. On the front of the arm 3 are provided various switches including a start/stop switch 6 instructing start and stop of the sewing work.

A large vertically elongated liquid crystal display 7 is provided on the front of the pillar 2. The liquid crystal display 7 is capable of displaying in full color. The display 7 is adapted to display various stitch patterns such as normal stitches, embroidery patterns and the like, names of various functions necessary for sewing work, various messages and the like.

A known embroidery frame moving device 8 is adapted to be detachably attached to a left end side of the bed 1. The embroidery frame moving device 8 moves an embroidery frame 10 holding workpiece cloth freely in the X and Y directions on the bed 1. In the embodiment, the direction in which the bed 1 extends or the horizontal direction is the X direction, and the crosswise direction perpendicular to the X direction is the Y direction as shown in FIG. 1. The embroidery frame moving device 8 includes a body 8*b* which is at the level of an upper surface (bed surface) of the bed 1 when the device is attached to the bed 1 and a driving section 8*a* which is mounted on an upper surface of the body 8*b* so as to be movable. The driving section 8*a* has a side on which a carriage is mounted so as to be movable in the Y direction. The embroidery frame 10 has a coupling part 10*a* (see FIG. 2) which is detachably coupled to the carriage. An X-direction driving mechanism is provided in the body 8*b* for driving the driving part 8*a* in the X direction although not shown in the drawings. The X-direction driving mechanism comprises an X-direction feed motor. A Y-direction driving mechanism is provided in the driving section 8*a* for driving the carriage in the Y direction. The Y-direction driving mechanism comprises a Y-direction feed motor.

When attached to the bed 1, the embroidery frame moving device 8 is electrically connected to a control device (control unit) of the electronic sewing machine M. In this case, an embroidering mode is set instead of a normal stitch mode, and the control device controls the X- and Y-direction feed motors and the like based on embroidering data etc. As a result, the embroidery frame 10 is moved in the X and Y directions so that an embroidering operation is carried out on the workpiece cloth held on the embroidery frame 10.

The embroidery frame 10 will now be described in detail with reference to FIGS. 2 to 12. In the following description, the embroidery frame 10 has a side formed with a coupling part 10*a* which is coupled to the embroidery frame moving device 8 is regarded as a front for the sake of explanation. The embroidery frame 10 has a lower frame 16, an upper frame 18 clamping the workpiece cloth in cooperation with the lower frame 16 and a pair of clamping mechanisms 11R and 11L pressing the upper frame 18 against the lower frame 16 and holding the upper frame 18 in the pressed state. The clamping mechanisms 11R and 11L are located at rear parts of the right and left sides of the embroidery frame 10 respectively. In this case, a slightly horizontally long rectangular embroiderable area A is defined inside the embroidery frame 10. The clamping mechanisms 11R and 11L are disposed so as to sandwich the embroiderable area A. The clamping mechanisms 11R and 11L are disposed so as to be horizontally symmetrical.

The lower frame 16 is comprised of a metal plate and includes a rectangular frame-shaped holding plate 16*a* holding workpiece cloth from below and a rising wall 16*b* provided integrally with the holding plate 16*a* so as to rise from an outer periphery of the holding plate 16*a*. The holding plate 16*a* has a centrally located relatively larger rectangular opening 16*c* used for the embroidering purpose. A silicon rubber tape 17 for preventing workpiece cloth from slipping is affixed to a rectangular portion which is formed on the upper surface of the holding plate 16*a* so as to be opposed to the upper frame 18. The lower frame 16 has a front end to which a coupling portion 10*a* is secured by screws. The coupling portion 10*a* is to be coupled with the embroidery frame moving device 8. Furthermore, the lower frame 16 includes right and left sides having rear edges to which supporting members 20R and 20L for supporting the clamping mechanisms 11R and 11L are secured, respectively.

Figure 9:
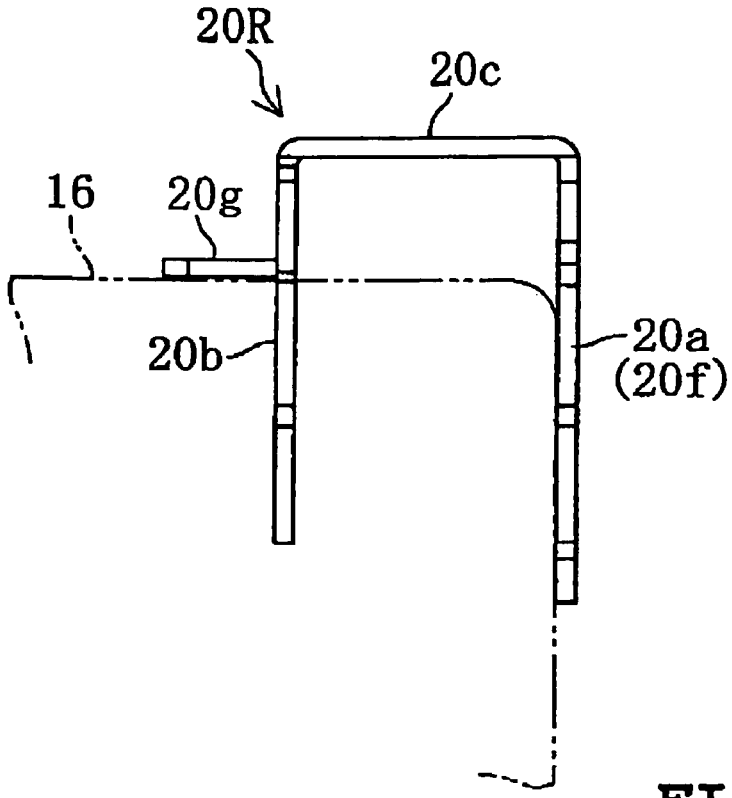
FIG. 9 is a plan view of a supporting member.
Figure 10:
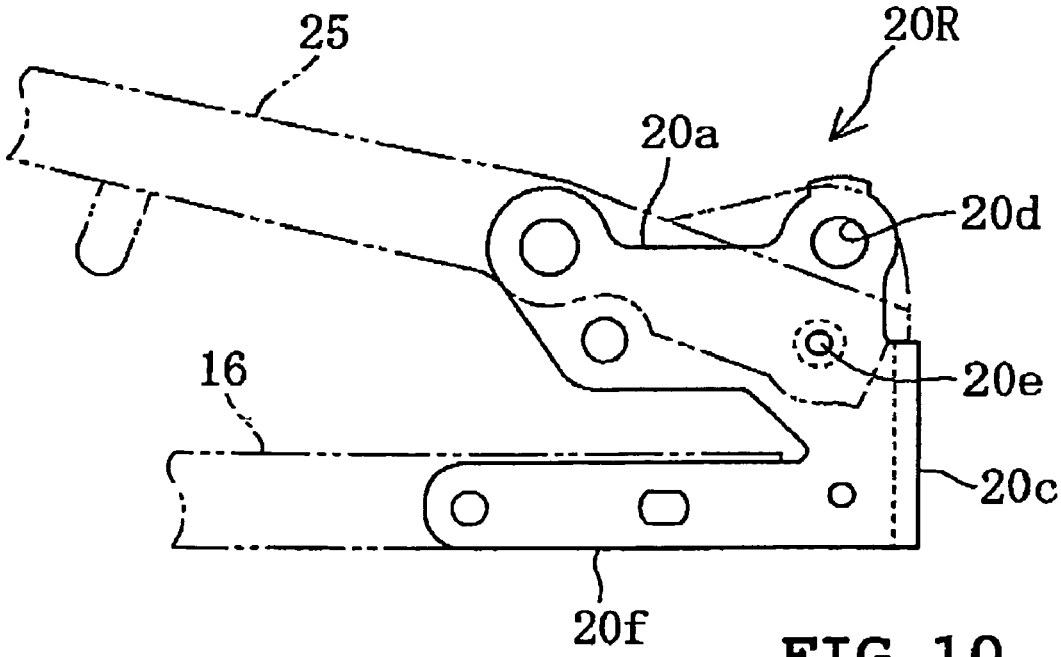
FIG. 10 is a right side view of the supporting member.

Since the supporting members 20R and 20L are disposed so as to be horizontally symmetrical, only the right supporting member 20R will now be described. The supporting member 20R is made by punching out and bending a thin metal plate as shown in FIGS. 9 and 10. The supporting member 20R has a first support wall 20*a* serving as a right support wall and a second left support wall 20*b* which is in parallel to the first support wall 20*a*. The first and second support walls 20*a* and 20*b* are connected integrally to each other by a connecting wall 20*c*, so as to be formed into a C-shape as viewed from above. The first support wall 20*a* has an engagement hole 20*d* and positioning small hole 20*e* formed in the rear thereof. A forwardly extending fixing wall or first fixing wall 20*f* is formed integrally on a lower part of the first support wall 20*a*. The first support wall 20*a* and the first fixing wall 20*f* are coplanar. Furthermore, the second support wall 20*b* has a leftward extending second fixing wall 20*g* formed integrally therewith. The supporting member 20R is fixed at the first fixing wall 20*f* thereof to a right rear end of the rising wall 16*b* by screws 21 (see FIG. 3). With this, the supporting member 20R is fixed at the second fixing wall 20*g* thereof to the right rear end of the rising wall 16*b* of the lower frame 16 by screws 21 (see FIGS. 5, 7 and 8).

Figure 2:
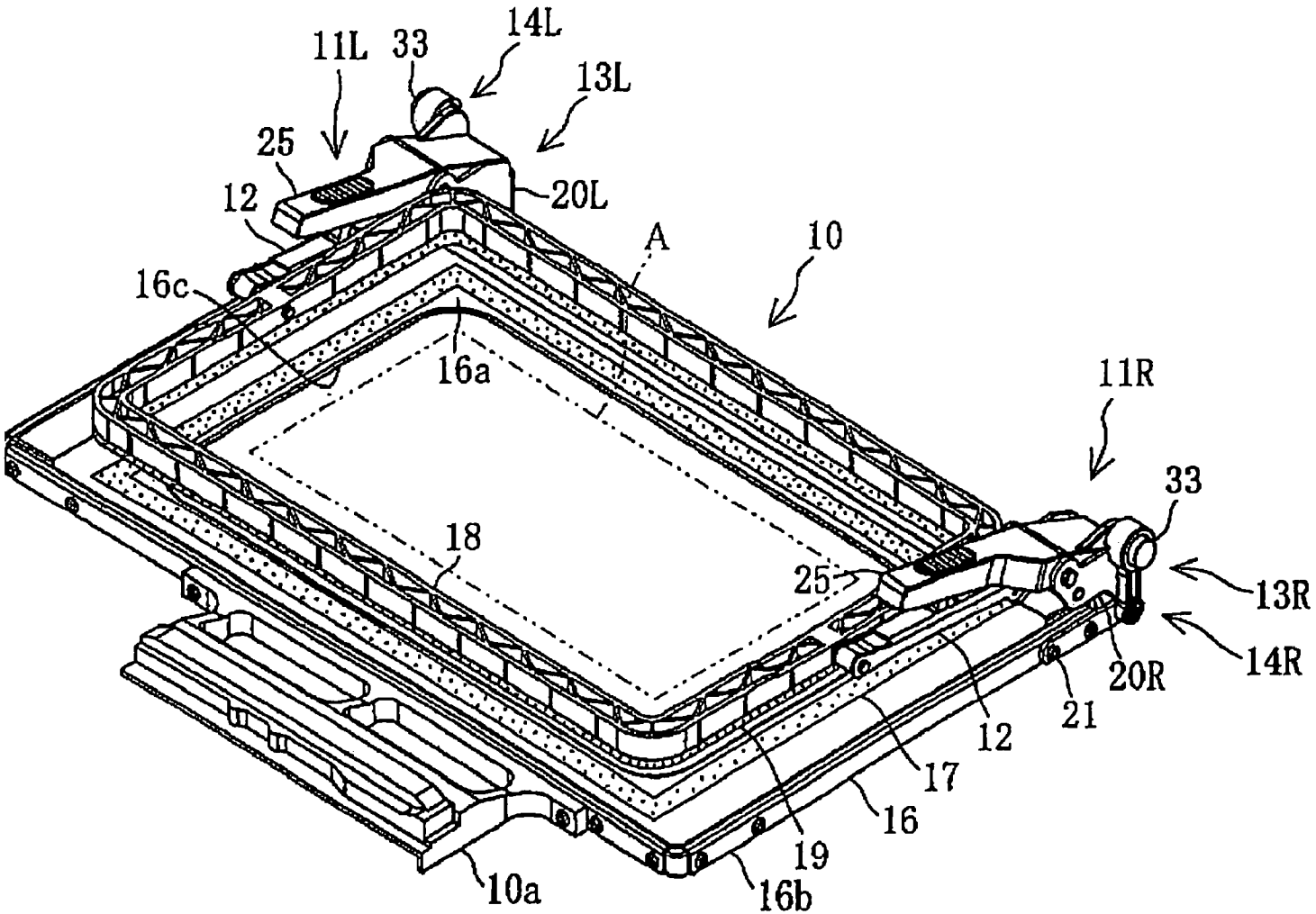
FIG. 2 is a perspective view of the embroidery frame.

On the other hand, the upper frame is made of a synthetic resin and is formed into a substantially rectangular frame shape extending along the holding plate 16*a* of the lower frame 16 (smaller than the rising wall 16*b*) as shown in FIG. 2. An antislip sponge tape 19 made from foamed rubber is affixed to the underside of the upper frame 18 so that workpiece cloth is elastically pressed. The upper frame 18 is pivotally coupled to coupling members 12 of the right and left clamping mechanisms 11R and 11L as will be described later, so that the upper frame 18 is swingable vertically between a holding position (see FIGS. 1 and 6) where the workpiece cloth is pressed against the lower frame 16 and an opening position (see FIGS. 2 and 3) where the upper frame 18 is upwardly spaced away from the lower frame 16.

The clamping mechanisms 11R and 11L will now be described. The clamping mechanisms 11R and 11L comprise the coupling members 12, locking mechanisms 13R and 13L, unlocking mechanisms 14R and 14L and opening bias springs 15 serving as frame-opening biasing members (see FIGS. 3 and 4), respectively, as shown in FIG. 2. Each coupling member 12 couples the upper frame 18 to the lower frame 16 so that the upper frame 18 is vertically swingable between the holding position and the opening position. The locking mechanisms 13R and 13L lock the upper frame at the holding position. The unlocking mechanisms 14R and 14L unlock the upper frame 18. The opening bias springs 15 bias the upper frame 18 from the holding position toward the opening side when the upper frame 18 is unlocked by the unlocking mechanisms 14R and 14L.

Only the right clamping mechanism 11R will be described in detail. Firstly, the coupling member 12 is formed so as to have a crosswise extending arcuate section (a C-shape with lower open end). The coupling member 12 is supported at its rear end on the first and second support walls 20*a* and 20*b* of the supporting member 20R by the first supporting pin 22, so as to be vertically swingable. The coupling member 12 is supported at its front end on a crosswise central portion of the right side of the upper frame 18 by the second supporting pin 23, so as to be pivotable.

Figure 11:
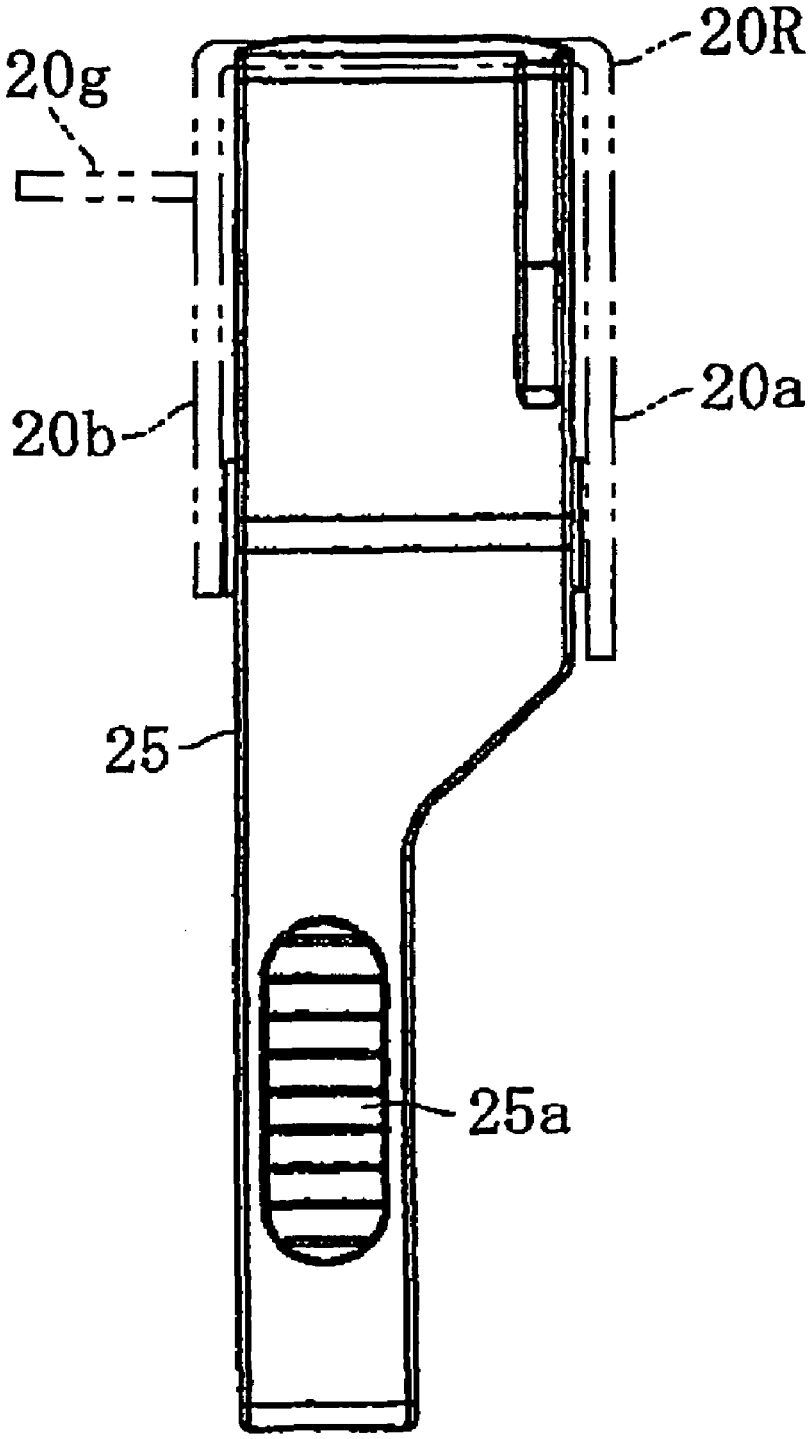
FIG. 11 is a plan view of a lock operation lever.
Figure 12:
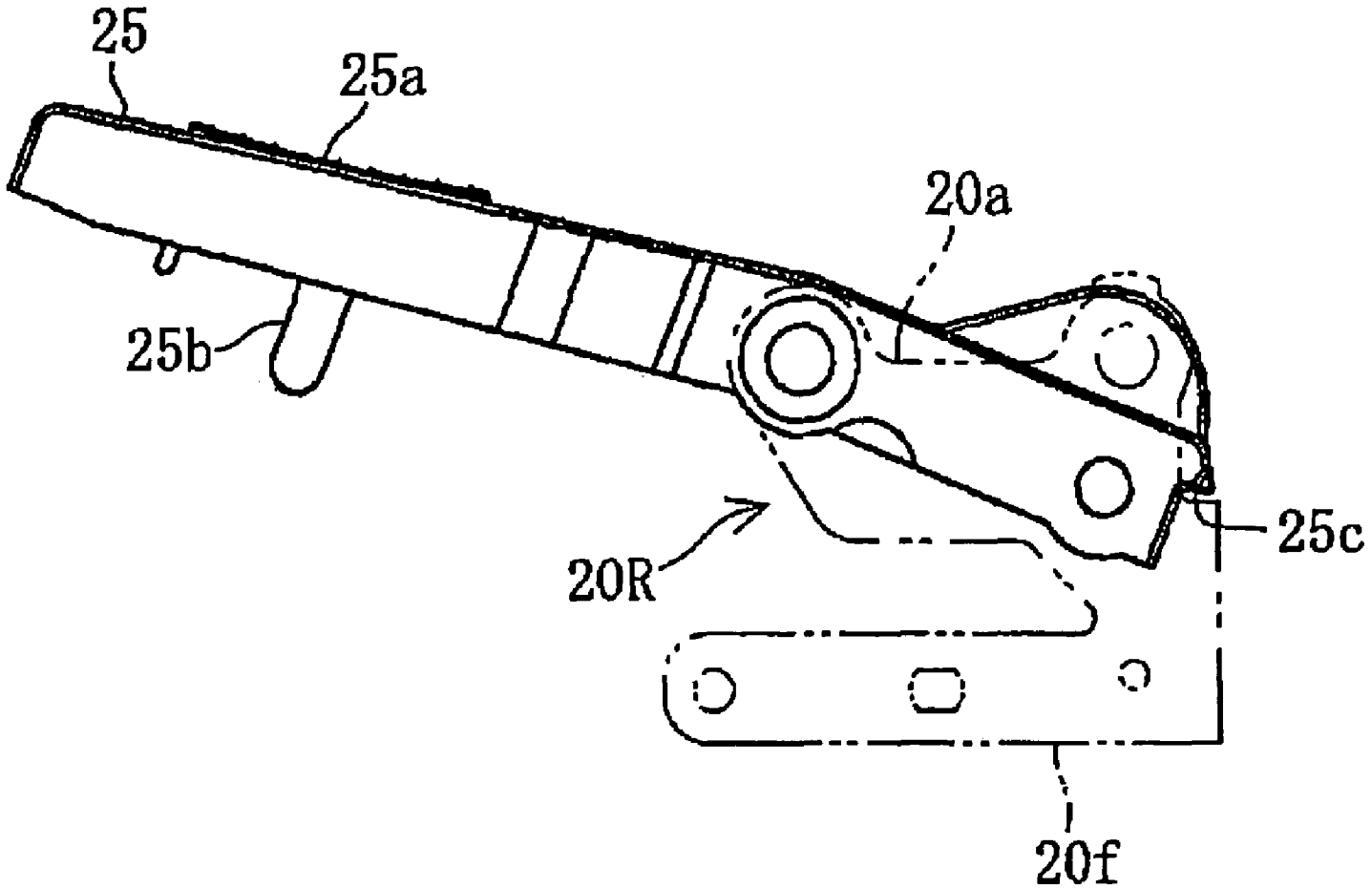
FIG. 12 is a right side view of the lock operation lever.

Next, the locking mechanism 13R is constructed as follows. As shown in FIGS. 3 to 8, the locking mechanism 13R comprises a locking operation lever 25 serving as a lock lever, a lock pin 26 mounted on the locking operation lever 25, the engagement hole 20*d* the lock pin 26 is capable of engaging and a first locking coil spring 27 serving a locking first biasing member. The locking operation lever 25 switches the upper frame 18 assuming the holding position to the locked state and comprises a crosswise long operation lever made from a synthetic resin as shown in FIGS. 2, 11 and 12. The locking operation lever 25 has a front end provided with an operation portion 25*a* operated by the worker. The locking operation lever 25 further has a protrusion 25*b* which is formed so as to be located below the operation portion 25*a* and so as to protrude downward. The protrusion 25*b* is formed integrally with the operation portion 25*a*.

Figure 3:
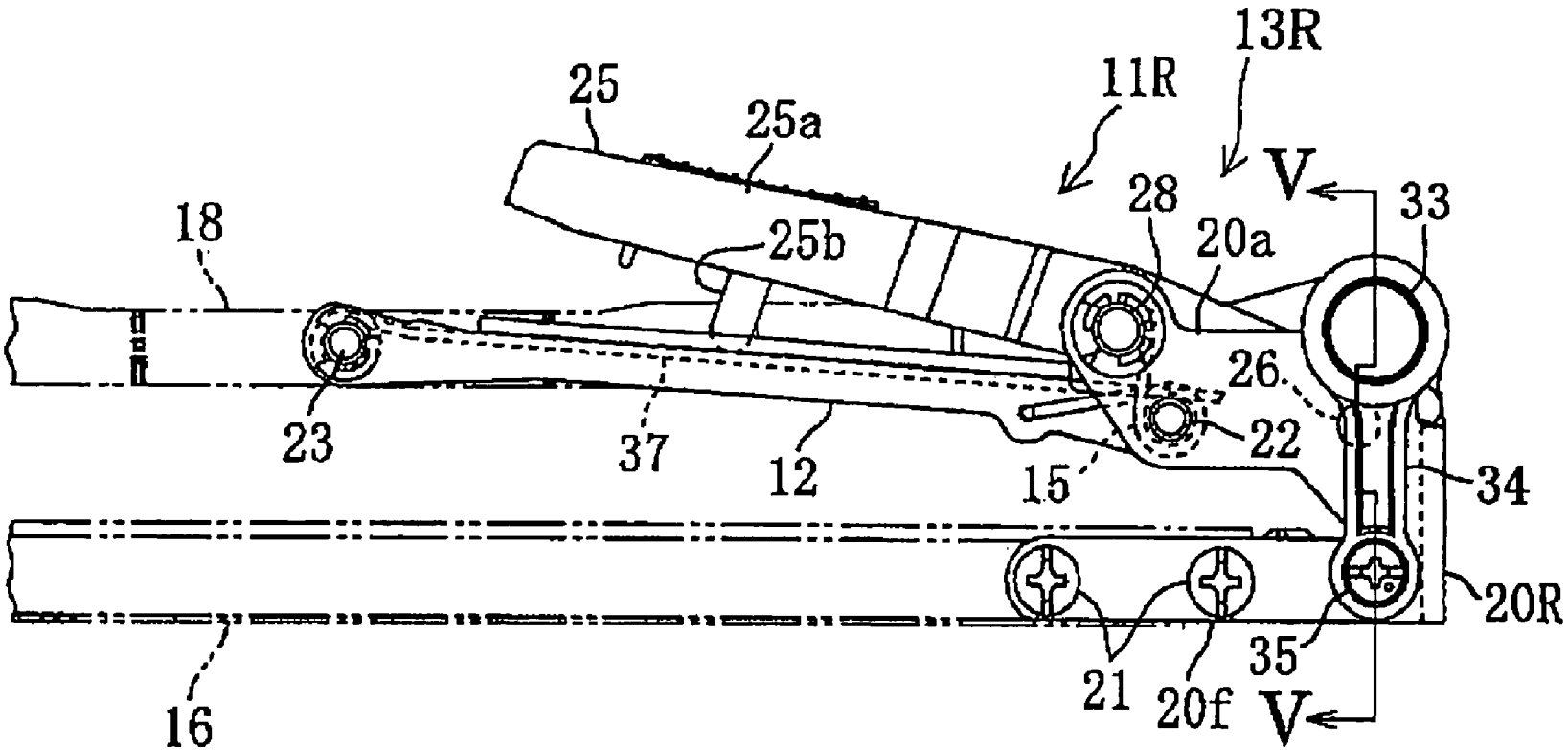
FIG. 3 is a right side view of a right clamping mechanism with an upper frame assuming an opening position.
Figure 6:
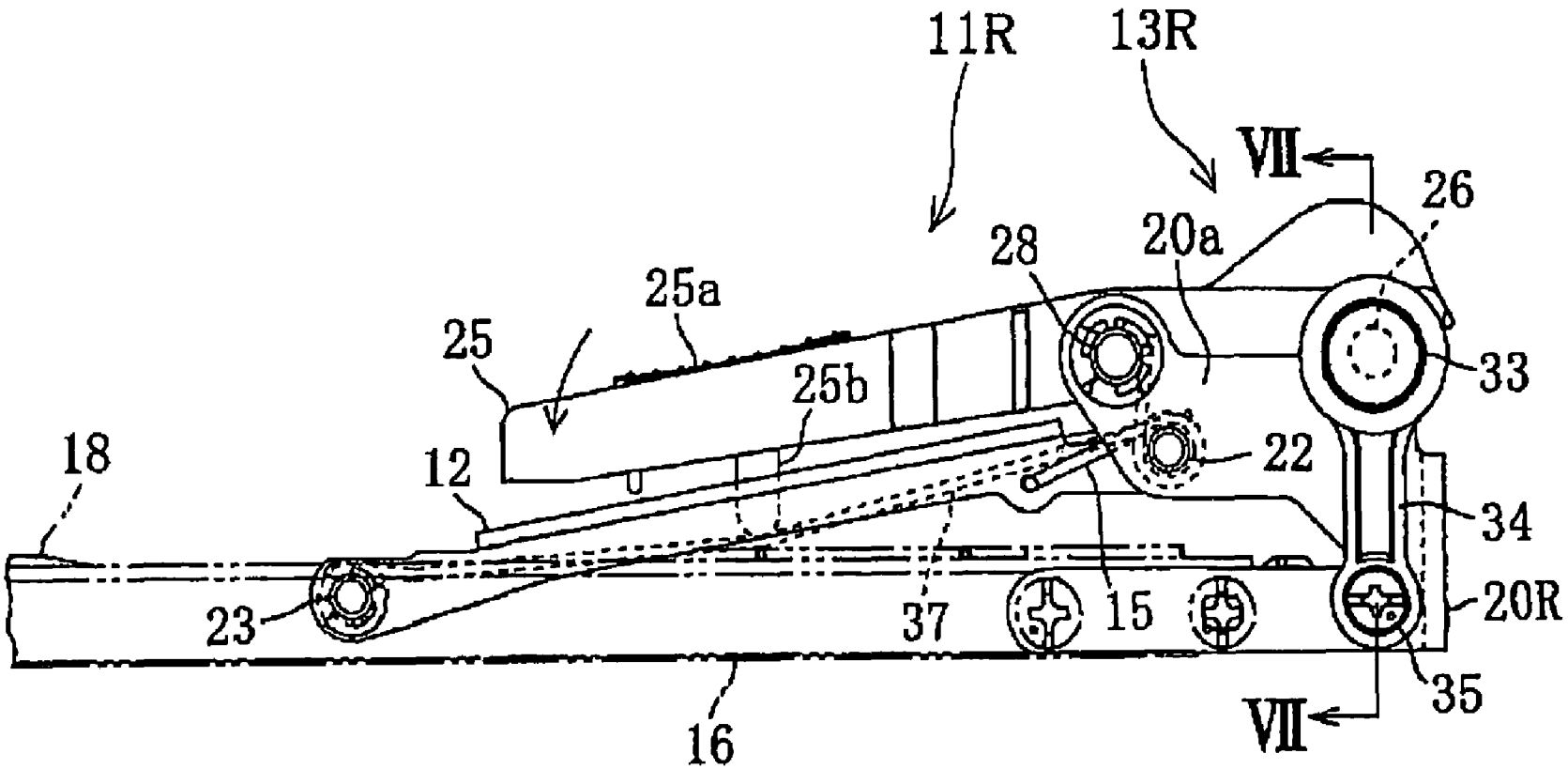
FIG. 6 is a right side view of the right clamping mechanism with the upper frame assuming a holding position.

The locking operation lever 25 is movably supported at its crosswise middle on a third support pin 28 together with the first and second support walls 20*a* and 20*b* at a position located higher than the first support pin 22. As a result, the locking operation lever 25 is displaceable between an opening position as shown in FIG. 3 and a pressed position as shown in FIG. 6. When the locking operation lever 25 is switched to the opening position, an abutting portion 25*c* of the rear end of the lever 25 abuts against an upper end of the coupling wall 20*c* of the supporting member 20R, thereby limiting the movement to the opening side. In this case, each opening bias spring 15 comprises a torsion coil spring and is fitted with an outer periphery of the first support pin 22. The opening bias spring 15 has an end engaging the coupling member 12 and the other end engaging the third support pin 28. As a result, as shown in FIG. 3, the coupling member 12 is biased by the spring force of the opening bias springs 15 in such a direction that the front end is lifted up relative to the lower frame 16.

Figure 4:
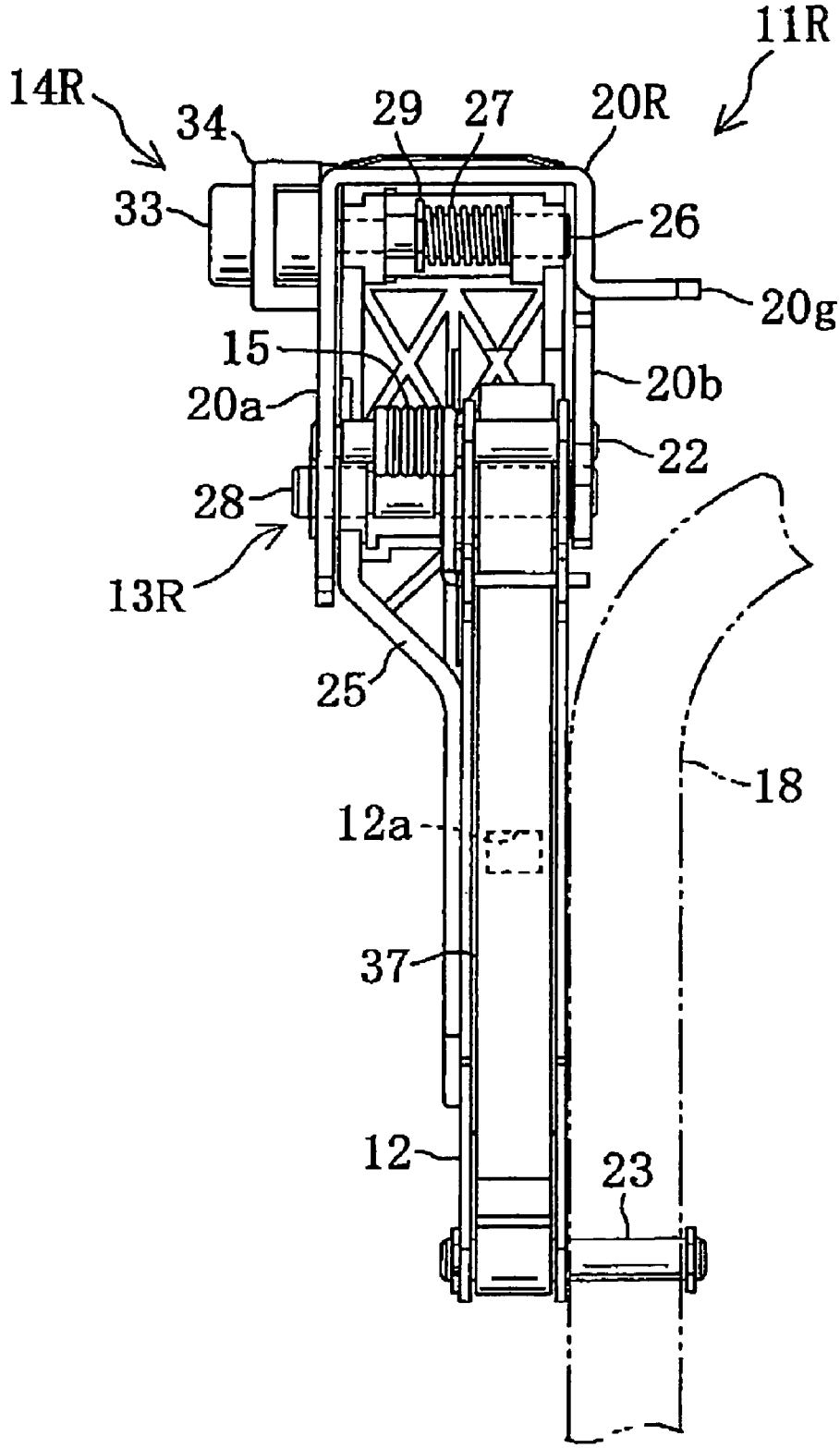
FIG. 4 is a bottom view of the right clamping mechanism.
Figure 5:
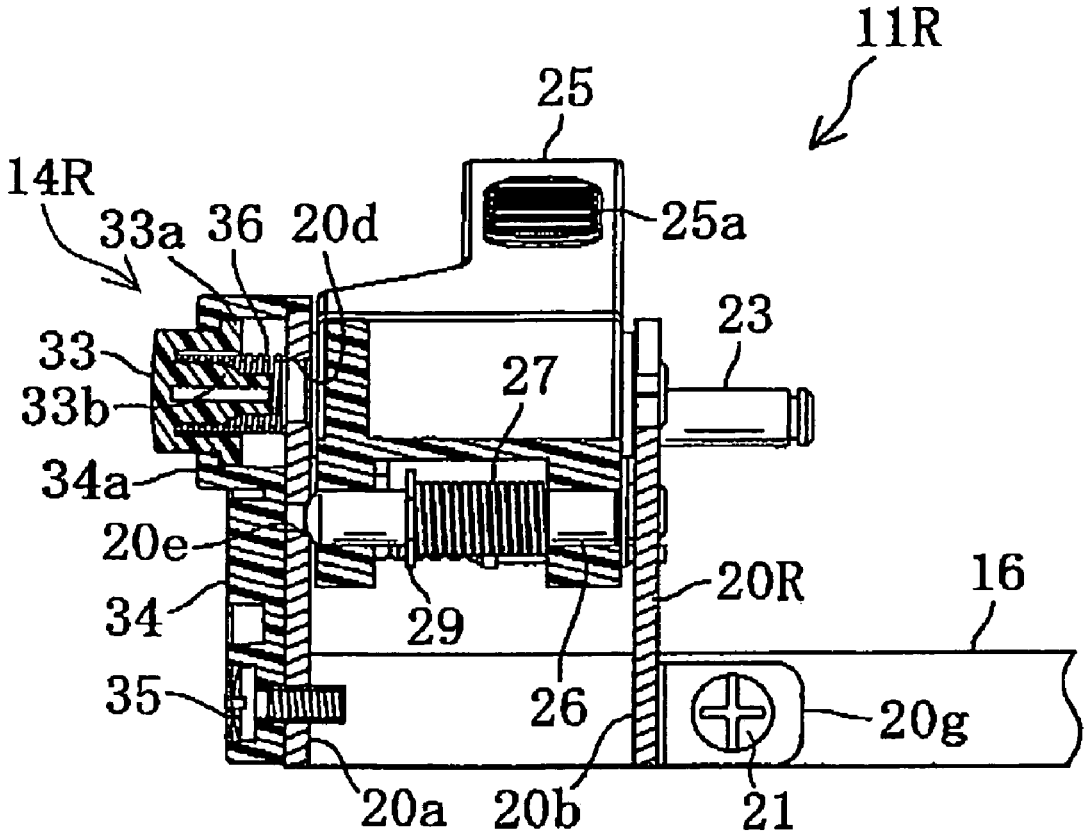
FIG. 5 is a longitudinally sectional rear view taken along line V-V in FIG. 3.
Figure 7:
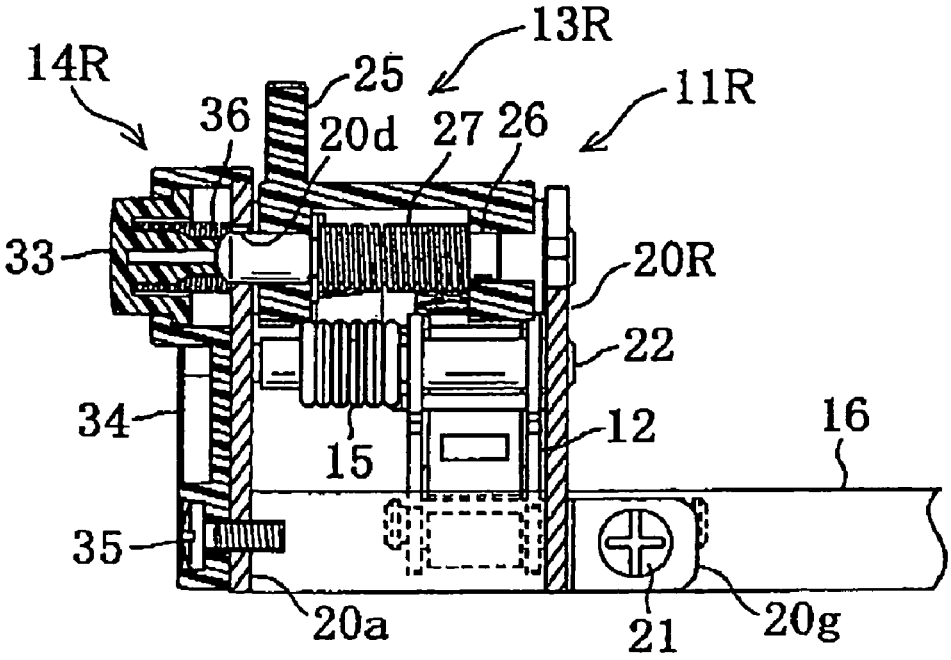
FIG. 7 is a longitudinally sectional rear view taken along line VII-VII in FIG. 6.

A crosswise directed lock pin 26 is supported on a rear end of the locking operation lever 25 so as extend through as shown in FIGS. 4 and 5. A stopper 29 comprising an E-ring is fitted so as to assume a position near the right end of the locking pin 26. The first locking coil spring 27 is provided between the stopper 29 of the lock pin 26 and the locking operation lever 25. As a result, the lock pin 26 is normally biased rightward, that is, toward the first supporting wall 20*a* side (to the left side as viewed in FIGS. 5, 7 and 8) relative to the supporting member 20R by the spring force of the first locking coil spring 27. The distal end of the lock pin 26 slightly engages the positioning hole 20*c* of the supporting member 20R when the locking operation lever 25 is swung upward, as shown in FIG. 5. On the other hand, when the locking operation lever 25 is swung downward, the lock pin 26 is fitted into the engagement hole 20*d* of the supporting member 20R as shown in FIG. 7. Thus, the upper frame 18 is adapted to be locked at the holding position via the locking operation lever 25.

The unlocking mechanism 14R has an unlocking operation button 33 serving as an unlocking operating member for disengaging the lock pin 26 from the engagement hole 20*d*, as shown in FIGS. 3 to 8. The unlocking mechanism 14R further has a holder 34 serving as a holding member for holding the unlocking operating button 33 so that the unlocking operation button 33 corresponds to the engagement hole 20*d* of the supporting member 20R. The unlocking operation button 33 is a push button made from a synthetic resin into the shape of a cylindrical cap as shown in FIGS. 3 to 5. The unlocking operation button 33 has an outer circumference on which an annular flange 33*a* is formed integrally. A pressing shaft 33*b* is formed integrally inside the unlocking operation button 33 so as to extend leftward. The holder 34 has a lower end mounted to an outer surface (right side surface) of the first supporting wall 20*a* of the supporting member 20R by a screw 35. The unlocking operation button 33 is held in the inner upper end of the holder 34 so as to assume a position corresponding to the engagement hole 20*d* of the supporting member 20R.

Figure 8:
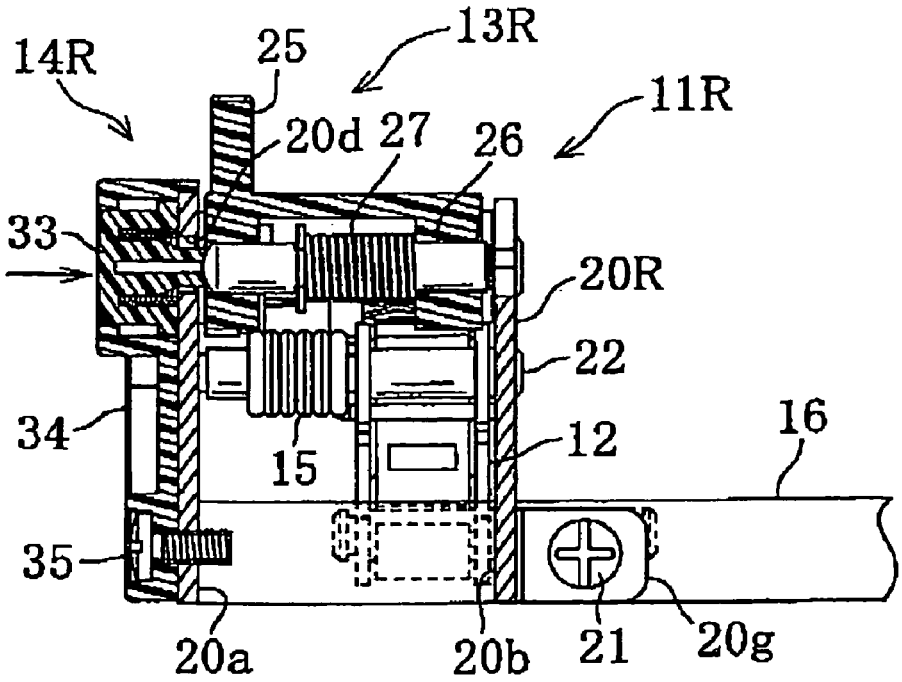
FIG. 8 is a view similar to FIG. 7, showing the condition when the upper frame assumes the opening position.

In this case, as shown in FIGS. 5, 7 and 8, the flange 33*a* is locked from inside by an annular locking portion 34*a* formed on the holder member 34, whereby the unlocking operation button 33 can be prevented from falling off from the holder 34. Furthermore, a coil spring 36 is provided about the pressing shaft 33*b* normally to bias the unlocking operation button 33 outward (rightward). Since the coil spring 36 has an outer diameter larger than a diameter of the engagement hole 20*d*, the coil spring can be prevented from falling off from the engagement hole 20*d*.

As the result of the above-described construction, when the worker presses the unlocking operation button 33 against the spring force of the coil spring 36, the distal end of the pressing shaft 33*b* enters the engagement hole 20*d*, thrusting the lock pin 26 fitted in the engagement hole 20*d* toward the unlocking side (inside). Consequently, the lock pin 26 can be disengaged from the engagement hole 20*d*, that is, unlocked.

Furthermore, the coupling member 12 of the clamping mechanism 11R is provided with a pressing bias spring 37 serving as a pressing bias member which elastically presses, against the lower frame 16, the upper frame 18 switched to the holding position. The pressing bias spring 37 comprises a metal elongated leaf spring and is disposed so as to extend crosswise in the interior of the coupling member 12 as shown in FIGS. 3 and 4. The pressing bias spring 37 has a front end wound on the second support pin 23 and a rear end fitted in a gap between the first and third support pins 22 and 28.

The coupling member has a rectangular through hole 1*a* formed in a crosswise central part thereof corresponding to the protrusion 25*b* of the locking operation lever 25 as shown in FIG. 4. When the worker presses the locking operation lever 25 downward so that the upper frame 18 is pressed into the holding position, the protrusion 25*b* of the locking operation lever 25 presses the crosswise middle portion of the spring 37 downward through the hole 12*a*, as shown in FIG. 6. As a result, when the upper frame 18 is located at the holding position, the pressing bias spring 37 is flexed downward such that the upper frame 18 is held in such a state that the workpiece cloth is pressed against the lower frame 16. When the upper frame 18 is located at the opening position, the protrusion 25*b* does not act upon the pressing bias spring 37 as shown in FIG. 3. The description of the left clamping mechanism 11L will be eliminated. The left clamping mechanism 11L is disposed so as to be horizontally symmetrical with the right clamping mechanism 11R.

The operation and effect of the embroidery frame 10 will now be described. The worker positions the workpiece cloth to be embroidered at a predetermined position on the upper surface of the lower frame 16 when the locking operation lever 25 is swung in an opening position and the upper frame 18 assumes the opening position where the upper frame is upwardly open over the lower frame 16, as shown in FIGS. 2 and 3. The workpiece cloth is thus placed, and the operation portion 25*a* of the locking operation lever 25 is pressed downward.

When the locking operation lever 25 is pressed down, the pressing bias spring 37 is pressed downward via the protrusion 25*b* as shown in FIG. 6. Accordingly, the coupling member 12, which is coupled via the second support pin 23 to the front end of the spring 37, is caused to pivot downward against the spring force of the opening bias spring 15. In this case, the upper frame 18 coupled via the second support pin 23 is simultaneously lowered toward the holding position. However, the lock pin 26 assumes a position which is lower than the engagement hole 20*d* of the supporting member 20 at this time, as shown in FIG. 5.

Simultaneously, the rear end of the locking operation lever 25 is moved upward. When the upper frame 18 reaches the holding position where the upper frame presses the workpiece cloth, the downward movement of the upper frame 18 is stopped. When the worker further presses the operation portion 25*a*, the rear end of the locking operation lever 25 is further moved upward while the middle portion of the pressing bias spring 37 is further flexed downward by the protrusion 25*b*, whereupon the distal end of the lock pin 26 overlaps the engagement hole 20*d*. At this time, as shown in FIG. 7, the spring force of the first locking coil spring 27 at once engages the lock pin 26 with the engagement hole 26 of the supporting member 20R. As a result, since the locking operation lever 25 is held in a pressing position by the engagement of the lock pin 26 with the engagement hole 20*d*, the upper frame 18 is locked at the holding position where the upper frame presses the workpiece cloth against the lower frame 16 by the spring force of the pressing bias spring 37 pressed by the protrusion 25*b*, as shown in FIG. 6.

Thus, when the upper frame 18 is pressed by the locking operation lever 25 simultaneously at the left and right clamping mechanisms 11, the left and right parts of the upper frame 18 are simultaneously moved downward to be locked at the holding position, whereupon clamping the workpiece cloth by the embroidery frame 10 is completed. However, the worker may press the right and left clamping mechanisms 11R and 11L individually in turn. In this case, one of the right and left sides of the embroiderable area of the workpiece cloth is positioned and thereafter, the other side may be positioned. Accordingly, fine positional adjustment can be carried out when the workpiece cloth is positioned on the embroidery frame. Thereafter, the embroidery frame 10 holding the workpiece cloth is attached to the carriage of the embroidery frame moving device 8 of the electronic sewing machine M as shown in FIG. 1. Subsequently, embroidering is carried out onto the workpiece cloth on the basis of desired embroidery stitch data.

Upon completion of embroidering, the worker detaches the embroidery frame 10 from the embroidery frame moving device 8. The worker then presses the unlocking operation button 33 against the spring force of the coil spring 36. As a result, the distal end of the shaft 33*b* of the unlocking operation button 33 enters the engagement hole 20*d*, and the lock pin 26 in the fitted or locked state is thrust into the unlocking side (inside), whereupon the lock pin 26 is released from the engagement with the engaging hole 20*d*.

In this case, the spring force of the opening bias spring 15 is at work via the coupling member 12 on the locking operation lever 25. Accordingly, the locking operation lever 25 is moved upward together with the coupling member 12 simultaneously when the lock pin 26 is disengaged from the engagement hole 20*d*. As a result, the abutting portion 25*c* of the lever 25 is moved until reaching the former opening position where the abutting portion 25*c* abuts against the supporting member 20, whereupon the upper frame 18 is moved to the opening position (see FIG. 3). When this opening operation by the unlocking operation button 33 is carried out simultaneously at right and left clamping mechanisms 11R and 11L, the upper frame 18 is opened simultaneously at right and left sides thereof. Subsequently, the worker takes out the embroidered workpiece cloth.

As described above, the clamping mechanisms 11R and 11L provided on the embroidery frame 10 comprise the coupling members 12, locking mechanisms 13R and 13L, unlocking mechanisms 14R and 14L, and opening bias springs 15, respectively. As the result of the above construction, the worker sets the workpiece cloth on the lower frame 16 and lowers the upper frame 18 to the holding position while the upper frame 18 is open. Consequently, since the upper frame 18 is automatically turned into the locked state by the locking mechanisms 13R and 13L, the workpiece cloth can be held easily and reliably.

On the other hand, when the embroidering has been finished, the worker only operates the unlocking operation button 33 so that the upper frame 18 is unlocked by the unlocking mechanisms 14R and 14L. Moreover, the upper frame 18 is automatically opened from the holding position to the opening position by the opening bias spring 15. Accordingly, the worker can easily open the upper frame 18 and take out the workpiece cloth.

Each clamping mechanism necessitates no drive source such as air cylinder and thus has a simpler construction. Moreover, since each clamping mechanism is prevented from a heightwise increase in the size thereof, each mechanism can be rendered more compact with respect to the heightwise dimension as compared with the conventional construction employing a four-bar linkage mechanism. Furthermore, the clamping mechanisms 11R and 11L are provided so as to be located at the right and left sides sandwiching the embroiderable area A of the embroidery frame 10. Consequently, since the worker can clamp the workpiece cloth individually at right and left sides, fine positional adjustment can be carried out when the workpiece cloth is positioned on the embroidery frame 10.

Furthermore, particularly in the foregoing embodiment, each of the supporting members 20R and 20L is disposed so that the first fixing wall 20*f* and first support wall 20*a* are coplanar. When the upper frame 18 is locked at the holding position, the reactive force of the pressing bias spring 37 and the opening bias spring 15 acts in such a manner that the gap between the pressing bias spring 37 and the opening bias spring 15 is spread. Since the first fixing wall 20*f* and first support wall 20*a* are coplanar, sufficient strength can be ensured to resist the aforesaid reactive force even when these walls are made of thin plates.

FIGS. 13 to 16 illustrate a second embodiment of the invention. Identical or similar parts in the second embodiment are labeled by the same reference symbols as those in the first embodiment and detailed description of these parts will be eliminated. Only the difference of the second embodiment from the first embodiment will now be described.

Figure 13:
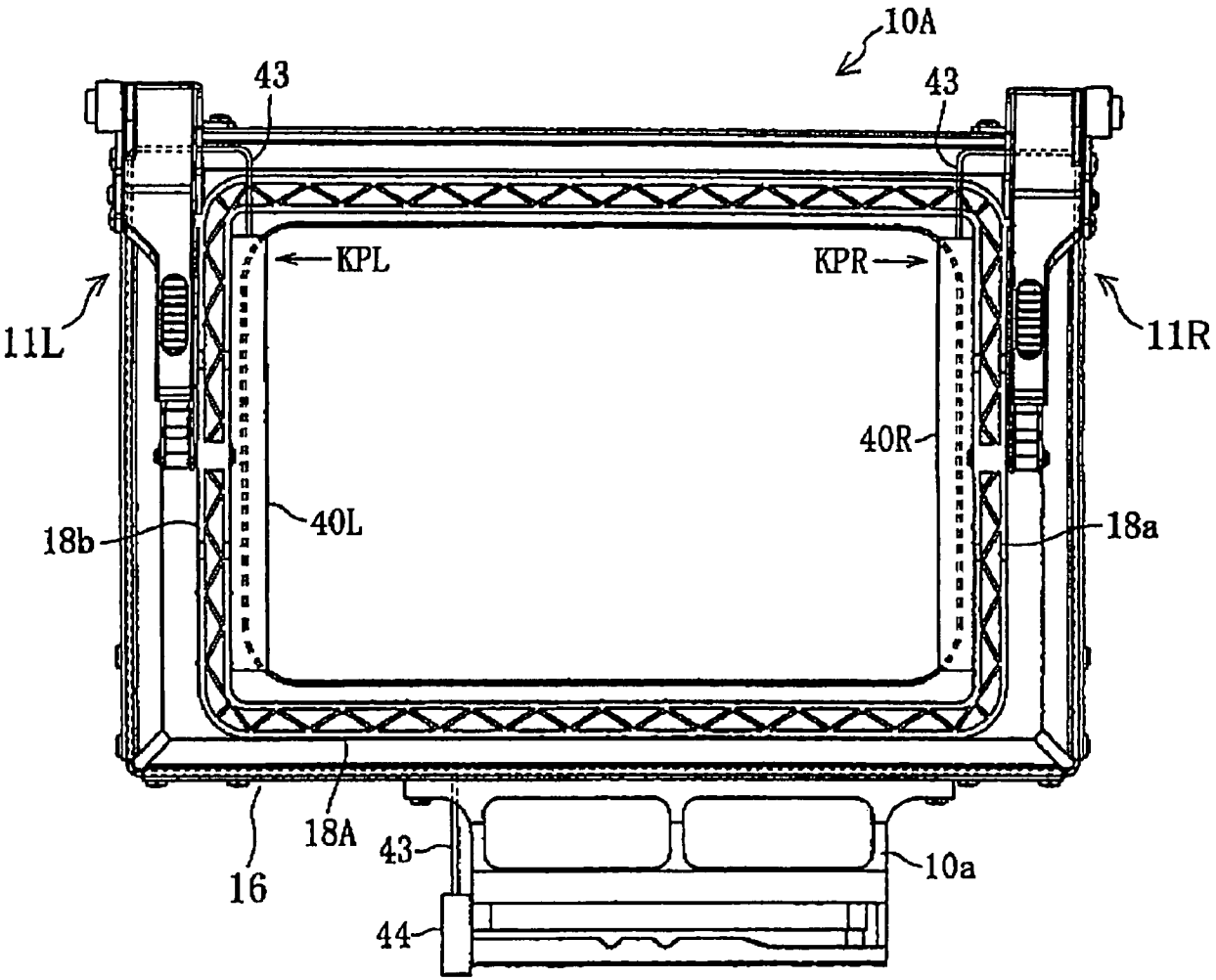
FIG. 13 is a plan view of the embroidery frame employed in a second illustrative example.
Figure 14:
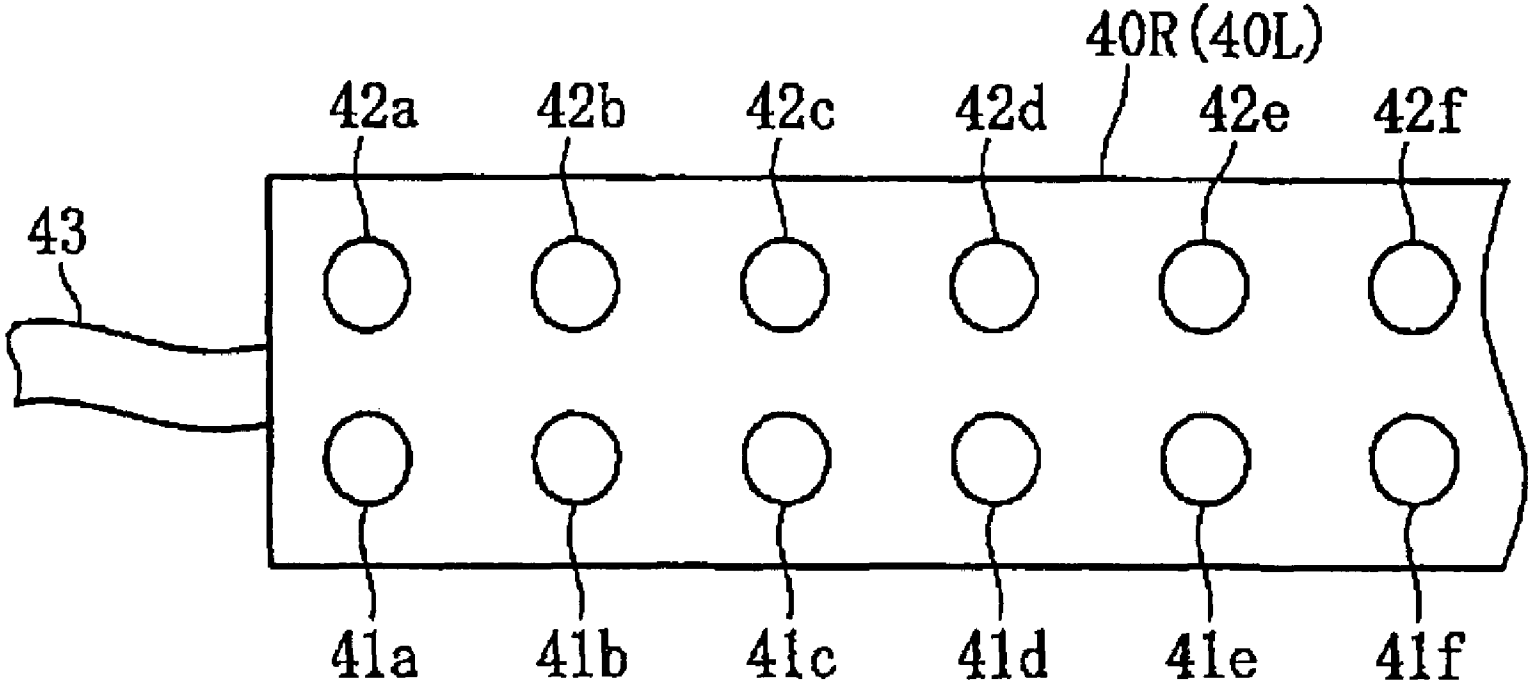
FIG. 14 is an enlarged bottom view of a part of a line sensor.

FIG. 13 illustrates an embroidery frame 10A of the embodiment. The embroidery frame 10A differs from the embroidery frame 10 in that right and left line sensors 40R and 40L are provided inside right and left frame portions 18*a* and 18*b* of the upper frame 18. Each of the line sensors 40R and 40L serves as a detector extending crosswise and comprises an optical sensor for detecting an end of the workpiece cloth. More specifically, as shown in FIG. 14, each of the line sensors 40R and 40L includes a crosswise elongated case and a light emitting element and a light detecting element both of which are located on the bottom of the case so as to be arranged crosswise. More specifically, a number of light-emitting optical fibers 41*a*, 41*b*, 41*c*, 41*d*, 41*e*, 41*f* and so on have distal ends aligned. A number of light-detecting charge coupled devices (CCDs) are aligned so as to correspond to the light-emitting optical fibers. In this case, the light-emitting optical fibers and light-detecting CCDs are aligned at intervals of, for example, 0.5 mm. Distribution cables 43 extending from the line sensors 40R and 40L are connected through distribution passages of the lower frame 16 to an output connector 44 (see FIGS. 13 and 15) provided on the coupling frame 10*a*.

Figure 15:
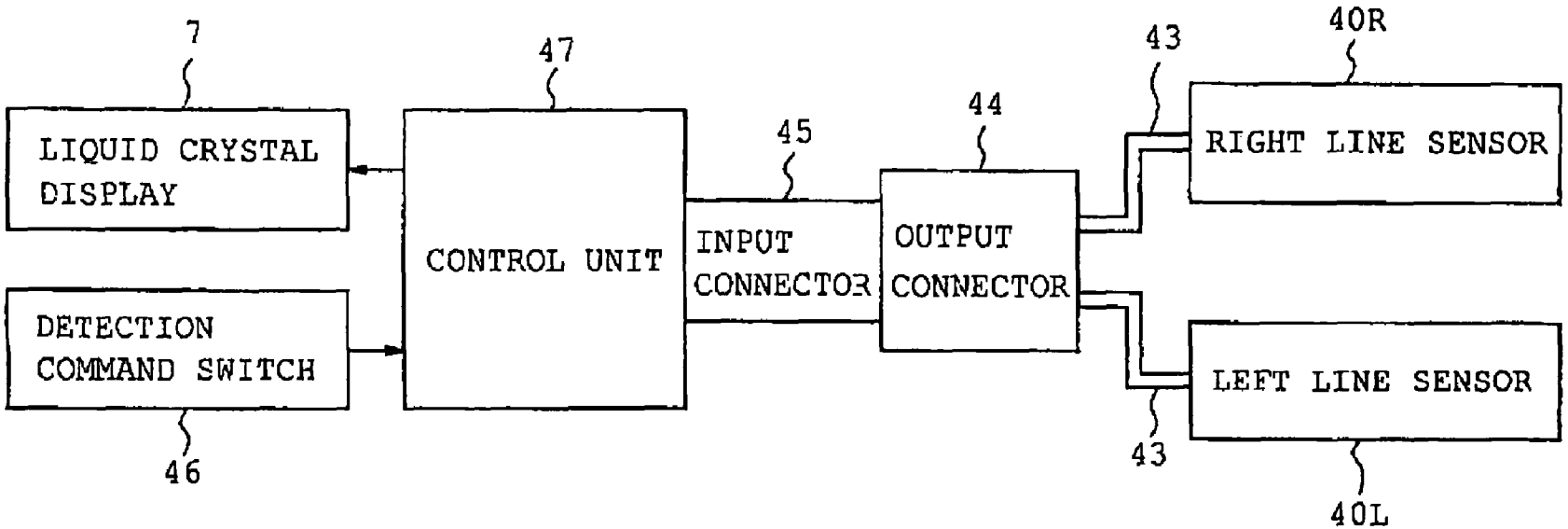
FIG. 15 is a block diagram showing an electrical arrangement of the sewing machine.

On the other hand, as shown only in FIG. 15, an input connector 45 connectable to the output connector 44 is provided in the driving section 8*a* of the embroidery frame moving device 8 to which the coupling frame 10*a* of the embroidery frame 10 is coupled. A detection instructing switch 46 is provided on a rear end of the lower frame 16 and is activated when the upper frame 18 is pressed into the holding position. The output and input connectors 44 and 45 are adapted to be simultaneously connected together when the embroidery frame 10A has been attached to the carriage of the embroidery frame moving device B. More specifically, as shown in FIG. 15, a control unit (C/U) 47 of the sewing machine M comprises a read only memory (ROM), a random access memory (RAM), an input/output interface and the like. The ROM stores a position information operation control program, a display control program for displaying various display information data on the liquid crystal display 7, and the like.

Detection signals from the CCDs 42 of the right and left line sensors 40R and 40L are capable of being supplied to the control unit 47 through the output connector 44 connected to the input connector 45. Moreover, the control unit 47 receives a detection activation signal from the detection instructing switch 46, delivering various display signals to the liquid crystal display 7.

When receiving a detection activation signal from the detection instruction switch 46, the control unit 47 emits light from a light source via both connectors 44 and 45 to each of the optical fibers 41*a* to 41*f* and so on of the respective line sensors 40R and 40L. On the other hand, the control unit 47 receives image signals from the CCDs 42*a* to 42*f* and so on by a time sharing system, analyzing the received signals to detect the positions of the ends of the workpiece cloth. Left and right sewing reference positions KPL and KPR corresponding to a specific optical fiber 41*x* are previously set in the control unit 47 (see FIG. 13).

When a decorative embroidery pattern of continuous design is sewn on an edge of large workpiece cloth such as curtain or tablecloth with the above-described sewing machine M, a sheet called "embroidery core" is affixed to part of an edge of the workpiece cloth in piles. As a result, the embroidery core is clamped in the rear side of the embroidery frame 10A instead of the workpiece cloth, for example, so that the workpiece cloth can reliably be held by the embroidery frame 10A. In this case, embroidering is repeated at a plurality of times while a part of the workpiece cloth held by the embroidery frame (a part disposed in the embroiderable area A) is horizontally shifted sequentially. In such a case, it is important to position the end of the workpiece cloth accurately relative to the embroidery frame 10A so that an embroidery pattern becomes finely continuous. An embroidery pattern is formed at a predetermined position by aligning the ends of the workpiece cloth with the left and right sewing reference positions KPL and KPR respectively. The above-described right and left line sensors 40R and 40L detect the positions of workpiece cloth ends using the difference in optical reflectances of the workpiece cloth and the embroidery core.

In the above-described construction, the detection instructing switch 46 is activated when the worker sets the workpiece cloth on the lower frame 16 and presses the upper frame 18 to the holding position side while operating the left and right locking operation levers 25. The control unit 47 then computes an amount of crosswise displacement of the right cloth end position relative to the sewing reference position KPR from the detection signal from the right line sensor 40R and the right sewing reference position KPR. The control unit 47 further computes an amount of crosswise displacement of the left cloth end position relative to the sewing reference position KPL from the detection signal from the left line sensor 40L and the left sewing reference position KPL. In representing an amount of displacement as positional information, for example, symbol "+" designates an amount of forward displacement and symbol "−" designates an amount of rearward displacement.

Figure 16:
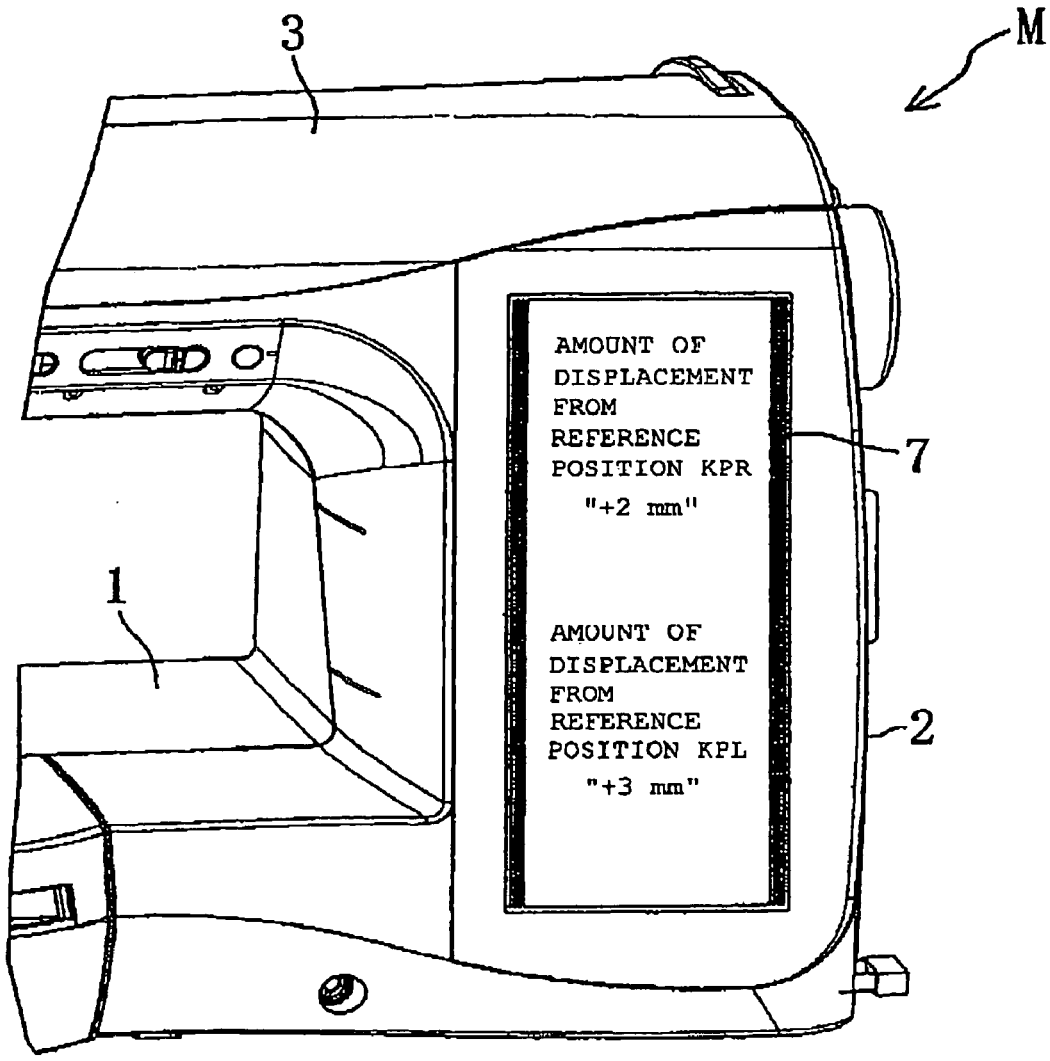
FIG. 16 is a perspective view of a liquid crystal display.
Figure 17:
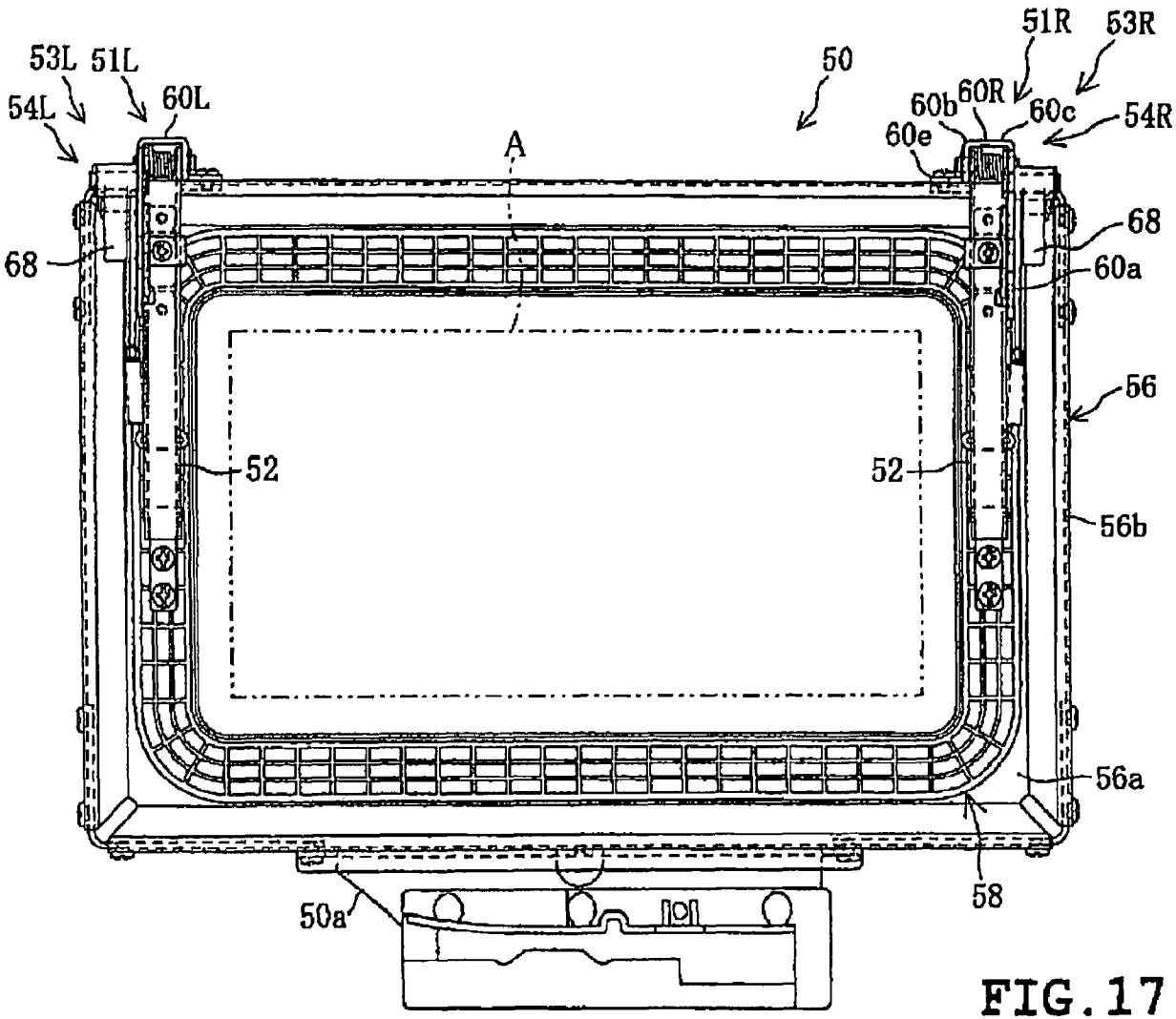
FIG. 17 is a plan view of the embroidery frame employed in a third illustrative example.

FIG. 16 exemplifies the liquid crystal display 7 displaying "amount of displacement from right reference position KPR: +2 mm" and "amount of displacement from left reference position KPL: +3 mm." Accordingly, the liquid crystal display 7 and control unit 47 constitute an informing unit. Based on the displayed amount of displacement, the worker corrects the set position of the workpiece cloth and can re-confirm an amount of displacement. More specifically, the workpiece cloth can be positioned with higher accuracy when the correction is repeated until an amount of displacement becomes zero.

The embroidery frame 10A has the paired right and left line sensors 40R and 40L both capable of detecting cloth end of the workpiece cloth in clamping the workpiece cloth and the output connector 44 for delivering to the sewing machine body side the detection signals indicative of cloth ends detected by the line sensors 40R and 40L. Accordingly, positional information of the workpiece cloth can be displayed on the display unit 7. As a result, the worker can easily recognize the state of the workpiece cloth positioned relative to the embroidery frame 10A, whereby the positioning accuracy can be improved. Furthermore, since each of the line sensors 40R and 40L is composed of an optical sensor comprising an optical fiber and CCDs, the size and costs of the line sensor can be reduced.

The following describes modified forms of the second embodiment. The sewing reference lines may be detected instead of the cloth ends of the workpiece cloth. In this case, the sewing reference lines may previously be drawn by an air-soluble marker on the workpiece cloth or may previously be sewn using basting yarn. In each case, the sewing reference lines are detected by the right and left line sensors 40R and 40L to obtain amounts of displacement relative to the sewing reference lines.

Carbon-containing rubber sheets each having a predetermined thickness may be affixed to the underside of the upper frame 18 instead of provision of the line sensors 40R and 40L. In this case, electrodes are connected to both ends of each rubber sheet. When voltage is applied between the electrodes, the rubber sheet has a larger resistance value when pressed than when not pressed. In embroidering, when the upper frame 18 is pressed against the workpiece cloth set on the lower frame 16, a resistance value between the electrodes of the rubber sheet becomes larger in proportion to the length of a pressed portion of the rubber sheet pressed by the workpiece cloth. Accordingly, the positions of cloth ends of the workpiece cloth can be obtained from the detected resistance values by computation.

The output connector 44 and input connector 45 may be connected together by another distribution cable. In this case, since the workpiece cloth can be set with the embroidery frame 10A being placed on a table etc, the working efficiency can be improved in setting the workpiece cloth.

FIGS. 17 to 21 illustrate a third embodiment of the invention. An embroidery frame 50 of the third embodiment differs from the embroidery frame 10 of the first embodiment in the construction of clamping mechanisms 51R and 51L. In the following description, the embroidery frame 50 has a side formed with a coupling part 50*a* which is coupled to the carriage of the embroidery frame moving device 8 is regarded as a front for the sake of explanation.

The embroidery frame 50 has a metal lower frame 56, a plastic upper frame 58 and a pair of right and left clamping mechanisms 51R and 51L for pressing the upper frame 58 against the lower frame 56 and holding the frame. The clamping mechanisms 50R and 50L are provided at two locations respectively so as to sandwich the embroiderable area A and so as to be horizontally symmetrical.

The clamping mechanisms 51R and 51L comprise, as in the first embodiment, the coupling members 52 which couple the upper frame 58 to the lower frame 56 so that the upper frame is vertically swingable, locking mechanisms 53R and 53L locking the upper frame 58 at the holding position, unlocking mechanisms 54R and 54L unlocking the upper frame 58 and opening bias springs 55 biasing the upper frame 58 assuming the holding position to the opening side when the upper frame 58 has been unlocked.

The lower frame 56 is comprised of a metal plate and includes a rectangular frame-shaped holding plate 56*a* having an opening 56*c* and a rising wall 56*b* provided integrally with the holding plate 56*a* so as to rise from an outer periphery of the holding plate 56*a*. A silicon rubber tape (not shown) for preventing workpiece cloth from slipping is affixed to the upper surface of the holding plate 56*a* opposed to the upper frame 58. The lower frame 56 has a front end to which a coupling portion 50*a* is secured by screws. The coupling portion 50*a* is to be coupled with the carriage of the embroidery frame moving device B. Furthermore, the lower frame 56 includes right and left sides having rear edges to which supporting members 60R and 60L for supporting the clamping mechanisms 51R and 51L are secured, respectively.

Figure 18:
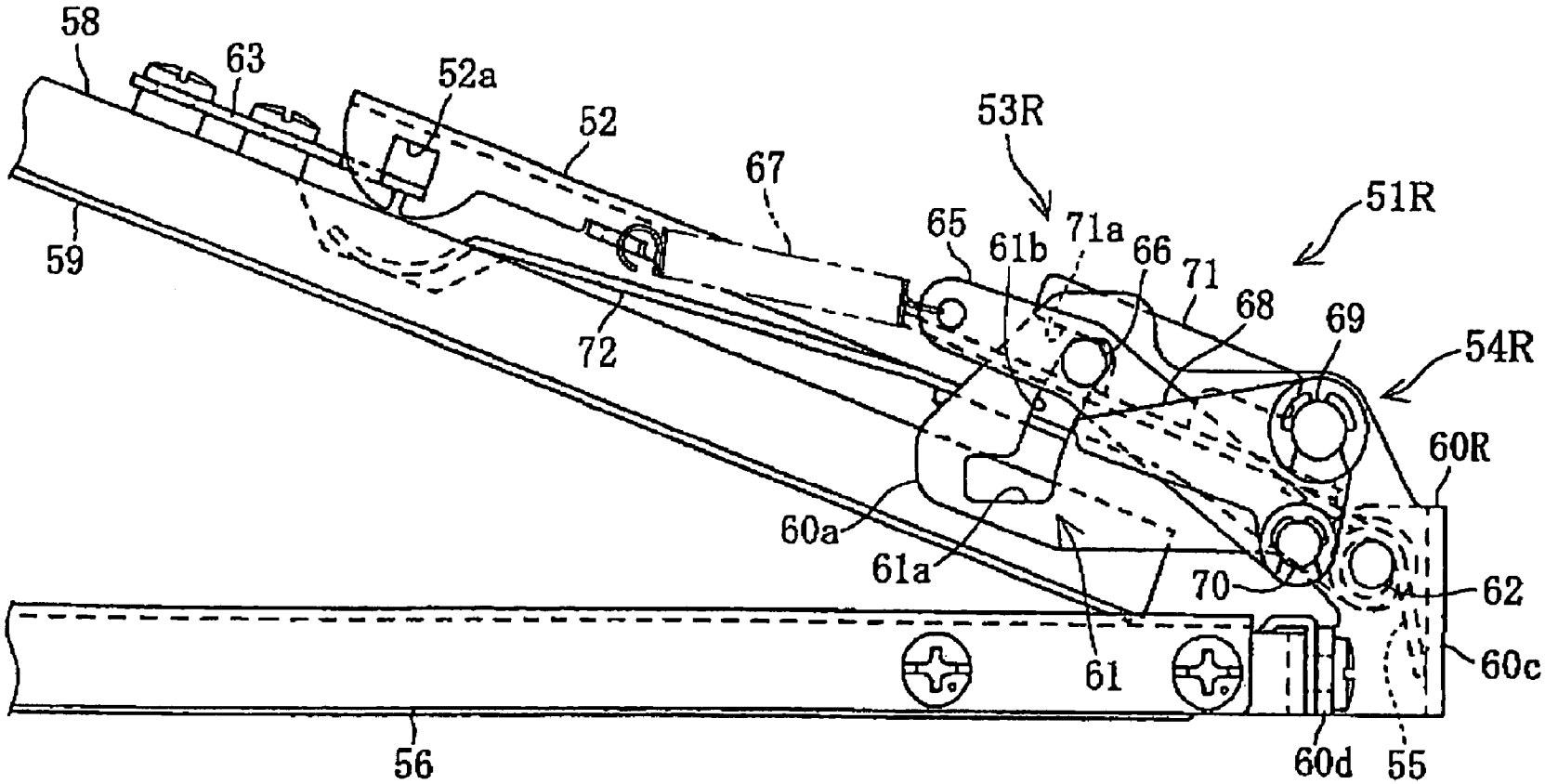
FIG. 18 is a right side view of the right clamping mechanism with the upper frame assuming the opening position.
Figure 21:
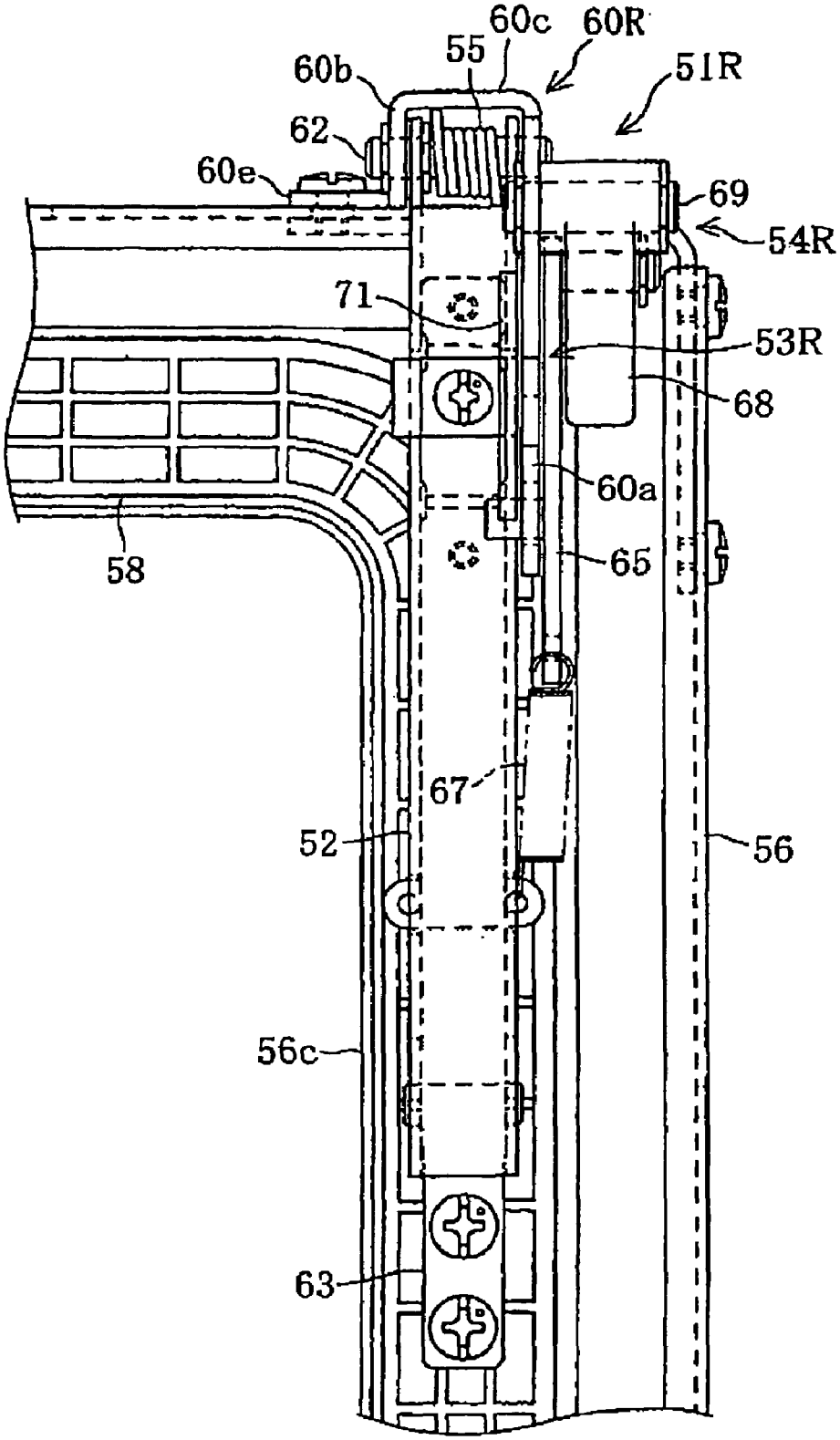
FIG. 21 is a partially plan view of the right clamping mechanism with the upper frame assuming the holding position.

Since the supporting members 60R and 60L are disposed so as to be horizontally symmetrical, only the right supporting member 60R will now be described. The supporting member 60R is made by punching out and bending a thin metal plate as shown in FIGS. 18 and 21. The supporting member 60R has a first support wall 60*a* serving as a right support wall and a second left support wall 60*b* which is in parallel to the first support wall 60*a*. The first and second support walls 60*a* and 60*b* are connected integrally to each other by a connecting wall 60*c*, so as to be formed into a C-shape as viewed from above.

Figure 19:
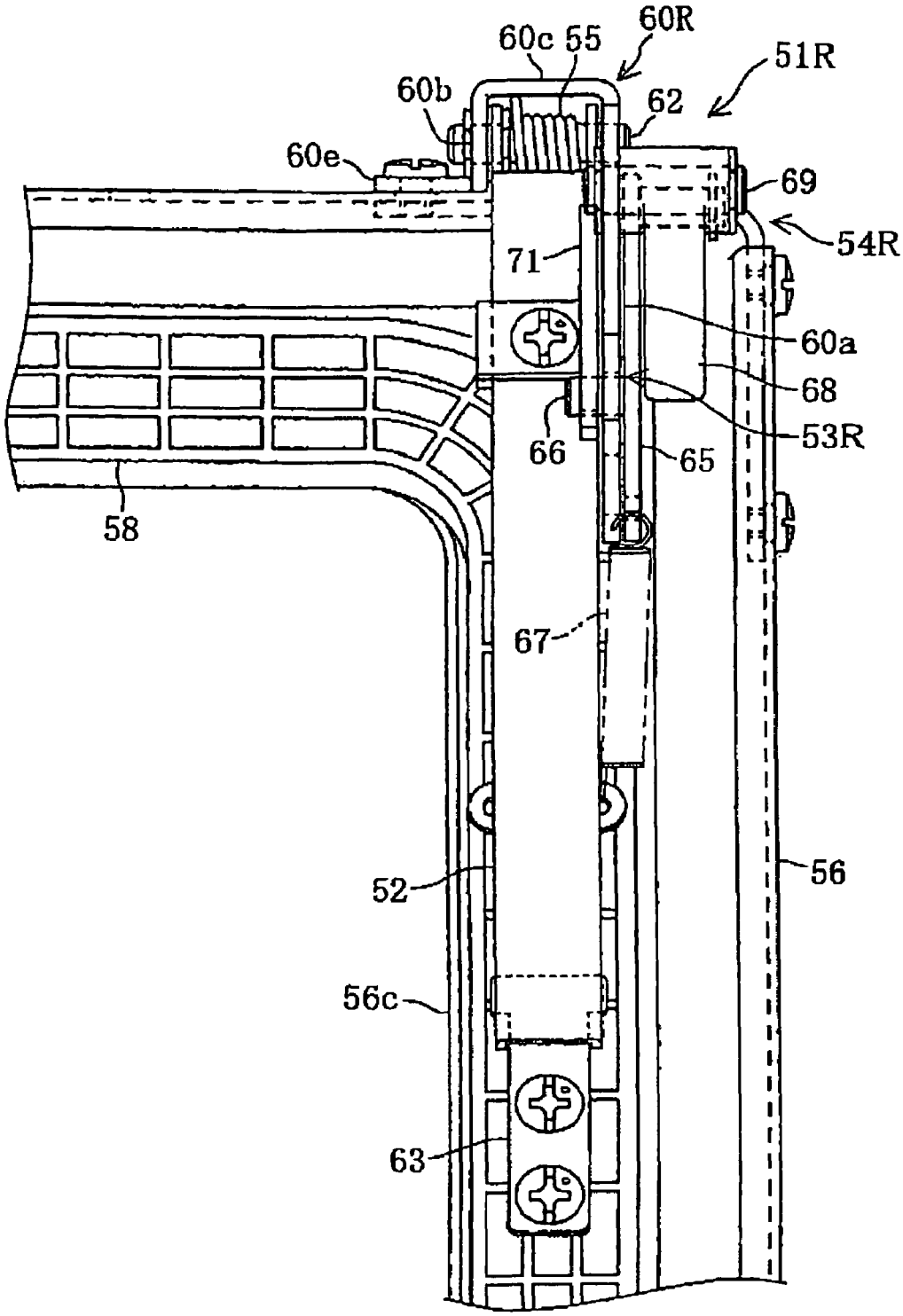
FIG. 19 is a partially plan view of the right clamping mechanism with the upper frame assuming the opening position.
Figure 20:
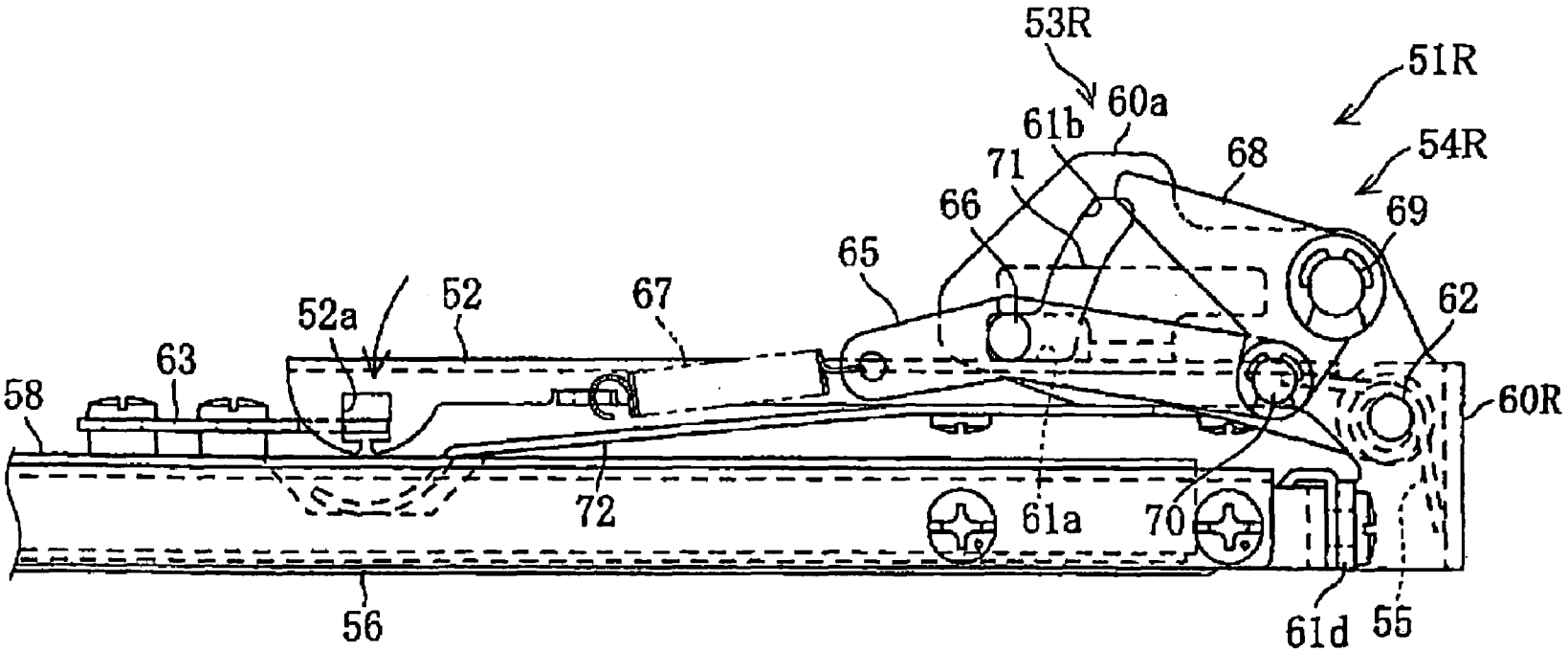
FIG. 20 is a right side view of the right clamping mechanism with the upper frame assuming the holding position.

A forwardly extending fixing wall or first fixing wall 60*f* is formed integrally on a lower part of the first support wall 60*a* (see FIGS. 18 and 20). Furthermore, the second support wall 60*b* has a leftward extending second fixing wall 60*g* formed integrally therewith (see FIGS. 19 and 21). The supporting member 60R is fixed at the first and second fixing walls 60*d* and 60*e* thereof to a right rear end of the lower frame 56 by screws 21.

A lock cam 61 comprised of a generally inverted L-shaped hole (groove) is formed in a front part of the first supporting wall 60*a* as shown in FIGS. 18 and 20. The lock cam 61 includes a crosswise extending horizontally linear lock cam portion 61*a* and an unlocking cam portion 61*b* which continuously extends from the rear end of the lock cam 61*a* so as to be curved more or less upward. The lock cam 61*b* is provided for locking the upper frame 58, whereas the unlocking cam 61*b* is provided for unlocking the upper frame 58.

On the other hand, the upper frame 58 is made of a synthetic resin and is formed into a substantially rectangular frame shape extending along the holding plate 56*a* of the lower frame 56. An antislip sponge tape 59 made from foamed rubber is affixed to the underside of the upper frame 58 so that workpiece cloth is elastically pressed. The upper frame 58 is pivotally coupled to coupling members 52 of the right and left clamping mechanisms 51R and 51L as will be described later, so that the upper frame 58 is swingable vertically between a holding position (see FIGS. 20 and 21) where the workpiece cloth is pressed against the lower frame 56 and an opening position (see FIGS. 18 and 19) where the upper frame 58 is upwardly spaced away from the lower frame 56. In this case, generally T-shaped engagement pieces 63 as shown from the upper surface side are mounted on middle upper surfaces of the right and left sides of the upper frame 58 respectively.

Only the right clamping mechanism 51R will be described in detail. Firstly, the coupling member 52 is formed so as to have a crosswise extending arcuate section. The coupling member 52 is supported at its rear end on the first and second support walls 60*a* and 60*b* of the supporting member 60R by the fourth supporting pin 62, so as to be vertically swingable. In this case, an opening bias spring 55 serving as an frame-opening biasing member is provided about the fourth support pin 62 and comprises a torsion coil spring. The opening bias spring 55 has an end engaging the coupling member 52 and the other end engaging the supporting member 60R. As a result, as shown in FIG. 13, the coupling member 52 is biased by the spring force of the opening bias springs 55 in such a direction that the front end thereof is lifted up relative to the lower frame 56, that is, the upper frame 58 is displaced upward.

Furthermore, a pair of right and left rectangular holes 52*a* are formed in the front ends of the coupling members 52 respectively (see FIGS. 18 and 20). The engagement pieces 63 provided on the upper frame 58 have distal end enlarged portions engaged with the rectangular holes 52*a* respectively. As the result of the above construction, the upper frame 58 is coupled at the crosswise middle portions of the right and left sides thereof to the distal ends of the coupling members 52 respectively.

Next, as shown in FIGS. 18 to 21, the locking mechanism 53R is constructed to swing in synchronization with the coupling member 52 and comprises a lock lever 65 provided with a lock pin 66 locking the upper frame 58 at the holding position and a second locking coil spring 67 serving a locking second biasing member biasing the lock pin 66 so that the lock pin is held by the lock cam 61*a*.

A generally triangular unlocking operation lever 68 is coupled to a right side of the rear end of the supporting member 60R so as to be pivotable (swingable vertically) about a fifth support pin 69 as shown in FIGS. 18 and 19. The unlocking operation lever 68 constitutes the unlocking mechanism 54R which will be described later. The lock lever 65 is comprised of a metal plate extending crosswise and has a rear end which is coupled to a lower end of the unlocking operation lever 68 so as to be pivotable (movable crosswise) about a sixth support pin 70. On the other hand, the second locking coil spring 67 extends between a middle portion or the connecting member 52 and a front end of the lock lever 65. The lock pin 66 is secured to a middle portion of the left side of the lock lever 65 so as to protrude leftward. The lock pin 66 engages the lock cam 61*a* of the supporting member 60R from the right.

Furthermore, a generally T-shaped coupling holding member 71 (see FIG. 20) as viewed from a side is secured to an upper surface of the coupling member 52. A moving direction of the lock pin 66 is limited or controlled by a notch 71*a* of the coupling holding member 71 as shown in FIG. 18, whereby the lock pin 66 is vertically swung together with the coupling member 52. In other words, the distal end of the lock pin 66 is moved along the upper surface of the coupling member 52. More specifically, the lock pin 66 is vertically movable together with the coupling member 52 over the lock cam 61*a* and the unlocking cam 61*b* by the control of the coupling holding member 71.

When the lock pin enters the lock cam 61*a*, the lock pin 66 is retained in the engagement with the lock cam 61*a* by the spring force of the second locking coil spring 67. Accordingly, the lock pin 66 is not disengaged from the lock cam 61*a* unless The unlocking operation lever 68 is operated.

Thus, the lock lever 65 is moved forward when the lock pin 66 engages the lower lock cam 61*a*. Accordingly, the unlocking operation lever 68 is switched to the upwardly directed pressing position (see FIG. 20) thereby to be locked at the holding position via the coupling member 52. Next, the unlocking mechanism 54R has an unlocking lever 68 which is coupled to the supporting member 60R so as to be pivotable (vertically swingable) about the fifth support pin 69. The unlocking lever 68 is supported on the supporting member 60R so as to be pivotable. The unlocking lever 68 moves the lock lever 65 rearward so that the lock pin is moved from the lock cam 61*a* to the unlocking cam 61*b* against the biasing force of the second locking coil spring 67. When the worker presses the unlocking lever 68 downward against the spring force of the second locking coil spring 67, the lock lever 65 is moved rearward via the sixth support pin 70 such that the lock pin 66 is disengaged from the lock cam 61*a*, being moved to the unlocking cam 61*b*. The unlocking lever 68 is then switched to the downward opening position (see FIG. 18), whereupon the upper frame 58 is moved via the coupling member 52 to the opening position by the spring force of the opening bias spring 55. Furthermore, the clamping mechanism 51R also includes a pressing bias spring 72 provided on the coupling member 52 so as to serve as a pressing bias member elastically pressing the upper frame 58 switched to the holding position against the lower frame 56. The pressing bias spring 72 comprises a metal elongated leaf spring and is disposed so as to extend crosswise in the interior of the coupling member 52 as shown in FIGS. 18 and 20. The pressing bias spring 72 has a front end which is curved so as to abut against the upper surface of the upper frame 58. The pressing bias spring 72 further has a rear end which is fixed to the coupling member 52.

The rear end of the pressing bias spring 72 is pressed downward when the upper frame 58 assumes the holding position. Accordingly, the pressing bias spring 72 is upwardly flexed as shown in FIG. 20, so that the upper frame 58 presses the workpiece cloth against the lower frame 56 by the spring force of the spring 72. The upper frame 58 is then held in a pressing state by the spring force. When the upper frame 58 assumes the opening position, the pressing bias spring 72 flexed returns to the former state as shown in FIG. 18. The description of the left clamping mechanism 51L will be eliminated. The left clamping mechanism 51L is disposed so as to be horizontally symmetrical with the right clamping mechanism 51R.

The operation and effect of the embroidery frame 50 will now be described. When the unlocking operation lever 68 is caused to pivot to the downwardly directed opening position such that the lock pin 66 is located in the unlocking cam 61*b*, the upper frame 58 assumes the opening position where the upper frame is upwardly open over the lower frame 56, as shown in FIGS. 18 and 19. In this state, the worker positions the workpiece cloth so that the workpiece cloth assumes a predetermined position on the upper surface of the lower frame 56, placing the workpiece cloth. The worker then presses the front end of the coupling member 52 downward. When the upper frame 58 is lowered to a predetermined pressing position, the lock pin 66 is moved by the spring force of the second locking coil spring 67 from the lower end of the unlocking cam 61*b* to the front end of the lock cam 61*a*. The lock lever 65 is simultaneously moved forward such that the unlocking operation lever 68 is caused to pivot thereby to assume an upwardly directed pressing position.

In this case, the upper frame 58 is locked at the holding position where the upper frame 58 presses the workpiece cloth against the lower frame 56. Thus, the pressing by the coupling member 52 is carried out simultaneously in both right and left clamping mechanisms 51R and 51L. The upper frames 58 are simultaneously lowered to be locked at the holding positions, whereupon clamping the workpiece cloth by the embroidery frame 50 is completed.

However, the worker may press the right and left clamping mechanisms 51R and 51L individually in turn. Then, the embroidery frame 50 holding the workpiece cloth is attached to the carriage of the embroidery frame moving device 8 of the electronic sewing machine M. Subsequently, embroidering is executed on the workpiece cloth on the basis of desired embroidery stitch data.

Upon completion of the embroidering, the worker detaches the embroidery frame 50 form the embroidery frame moving device 8. When the worker causes the unlocking operation lever 68 downward against the spring force of the second locking coil spring 67, the lock lever 65 is moved rearward so that the lock pin 66 is disengaged from the lock cam 61*a*. The lock pin 66 is moved upward against the spring force of the opening bias spring 55 while being brought into engagement with the unlocking cam 61*b*. As a result, the unlocking operation lever 68 is switched to the downward opening position (see FIG. 18). The upper frame 58 is caused to pivot (swing) upward via the coupling member 52. The opening operation by the unlocking operation lever 68 is carried out at right and left clamping mechanisms 51P and 51L simultaneously or individually in turn, whereby the upper frame 58 is moved to the opening position.

Thus, in the third embodiment, too, the upper frame 58 can be switched to the locked state when the worker only operates the coupling member 52 to lower the upper frame 58 to the holding position. Accordingly, the clamping work that holds the workpiece cloth on the embroidery frame 50 can be carried out easily. Furthermore, upon completion of the embroidering, the upper frame 58 is automatically displaced from the holding position to the opening position when the worker only causes the unlocking operation lever 68 to pivot. Consequently, the worker can easily open the upper frame 58 and take out the workpiece cloth.

Each clamping mechanism 51 necessitates no drive source such as air cylinder and thus has a simpler construction. Moreover, since each clamping mechanism is prevented from a heightwise increase in the size thereof, each mechanism can be rendered more compact with respect to the heightwise dimension as compared with the conventional construction employing a four-bar linkage mechanism. Furthermore, the clamping mechanisms 51R and 51L are provided so as to be located at the right and left sides sandwiching the embroiderable area A of the embroidery frame 50. Consequently, since the worker can clamp the workpiece cloth individually at right and left sides, fine positional adjustment can be carried out when the workpiece cloth is positioned on the embroidery frame 50.

The third embodiment can be modified as follows. Coupling retainer members 71 may be formed integrally on the coupling members 52 respectively. The coupling members 52 may be provided on outer peripheral sides of right and left sides of the upper frame 58, instead of the upper surfaces of the right and left sides of the upper frame 58. In this case, the upper frame 58 can be moved to the opening position in a horizontal state substantially in the same manner as to the holding position. Consequently, the workpiece cloth can easily be set and taken out. Additionally, the line sensors 40 in the foregoing second embodiment may be provided on the embroidery frame 50.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. An embroidery frame provided on a sewing machine with an embroidering function to hold workpiece cloth for execution of the embroidering function, the embroidery frame comprising:

a lower frame receiving a lower side of the workpiece cloth;

an upper frame clamping the workpiece cloth in cooperation with the lower frame therebetween; and a clamping mechanism pressing the upper frame against the lower frame, thereby holding the upper frame, the clamping mechanism including:

a coupling member coupling the upper frame to the lower frame so that the upper frame is vertically swingable between a holding position where the upper frame presses the workpiece cloth and an opening position where the upper frame is open upward;

a locking mechanism locking the upper frame at the holding position;

an unlocking mechanism unlocking the upper frame; and a frame-opening biasing member biasing the upper frame so that the upper frame is displaced to the opening position when unlocked by the unlocking mechanism, wherein the locking mechanism includes a lock lever and a lock pin, wherein the lock pin engages an engagement hole of a supporting member when the lock lever is swung upward.

2. The embroidery frame according to claim 1, wherein the lock lever is swung in synchronization with the coupling member, thereby locking the upper frame at the holding position, a lock cam provided on the supporting member secured to the lower frame and having a locking cam part which enables the upper frame to assume a locked state and an unlocking cam part which allows the upper frame to unlock, the locking and unlocking cam parts being continuous to each other, the lock pin engaging the lock cam, and another lock biasing member which biases the lock pin so that the lock pin is held by the locking cam part.

3. The embroidery frame according to claim 2, wherein the unlocking mechanism has an unlocking operation member pivotally supported on the supporting member and actuating the lock lever so that the lock pin is moved from the locking cam part to the unlocking cam part against a biasing force of said another lock biasing member.

4. The embroidery frame according to claim 2, wherein the coupling member has a press biasing member elastically biasing the upper frame switched to the holding position to the lower frame side.

5. The embroidery frame according to claim 1, wherein the lower frame includes the supporting member secured thereto, wherein the lock lever is structured to change to a locked state, the upper frame pivotally supported by the supporting member and assuming the holding position when the lock lever changes the upper frame to the holding position, wherein the lock pin is provided on the lock lever for locking the upper frame at the holding position via the lock lever, the lock pin being engageable with the engagement hole when the upper frame is switched to the holding position by the lock lever, and wherein a lock biasing member biases the lock pin in such a direction that the lock pin engages the engagement hole.

6. The embroidery frame according to claim 5, wherein the coupling member has a press biasing member elastically biasing the upper frame switched to the holding position to the lower frame side.

7. The embroidery frame according to claim 5, wherein the supporting member includes a fixing wall which is fixed to the lower frame and a supporting wall which supports the lock lever so that the lock lever is allowed to pivot and in which the engagement hole is formed, the fixing wall and the supporting wall being disposed so as to be coplanar.

8. The embroidery frame according to claim 7, wherein the coupling member has a press biasing member elastically biasing the upper frame switched to the holding position to the lower frame side.

9. The embroidery frame according to claim 5, wherein the unlocking mechanism includes an operation member which is operated so that the lock pin and the engagement hole are disengaged from each other and a holding member which holds the operation member so that the operation member corresponds to the engagement hole of the supporting member.

10. The embroidery frame according to claim 9, wherein the coupling member has a press biasing member elastically biasing the upper frame switched to the holding position to the lower frame side.

11. The embroidery frame according to claim 1, wherein the embroidery frame includes two clamping mechanisms that are provided so that an embroiderable area defined inside the upper and lower frames is located therebetween.

12. The embroidery frame according to claim 1, further comprising a detector capable of detecting an end of the workpiece cloth or an imaginary sewing reference line when the workpiece cloth is clamped between the upper and lower frames and an output connector for delivering to the sewing machine body side a detection signal indicative of the end of the workpiece cloth or the sewing reference line detected by the detector.

13. The embroidery frame according to claim 12, wherein the detector comprises an optical sensor.

14. The embroidery frame according to claim 1, wherein the coupling member has a press biasing member elastically biasing the upper frame switched to the holding position to the lower frame side.

15. A sewing machine with an embroidering function comprising:

an embroidery frame holding workpiece cloth for execution of the embroidering function, the embroidery frame including:

a lower frame receiving a lower side of the workpiece cloth;

an upper frame clamping the workpiece cloth in cooperation with the lower frame therebetween;

a clamping mechanism pressing the upper frame against the lower frame, thereby holding the upper frame, the clamping mechanism including:

a coupling member coupling the upper frame to the lower frame so that the upper frame is vertically swingable between a holding position where the upper frame presses the workpiece cloth and an opening position where the upper frame is open upward;

a locking mechanism locking the upper frame at the holding position;

an unlocking mechanism unlocking the upper frame; and a frame-opening biasing member biasing the upper frame so that the upper frame is displaced to the opening position when unlocked by the unlocking mechanism;

a detector capable of detecting an end of the workpiece cloth or an imaginary sewing reference line when the workpiece cloth is clamped between the upper and lower frames; and an output connector for delivering to the sewing machine side a detection signal indicative of the end of the workpiece cloth or the sewing reference line detected by the detector;

a sewing machine body to which the embroidery frame is attached, the sewing machine body including:

an input connector connectable to the output connector of the embroidery frame; and an informing unit receiving via the input connector the detection signal from the detector thereby to inform information about a position of the workpiece cloth or the sewing reference line relative to a predetermined sewing reference position.

* * * * *